US010726727B2

(12) United States Patent
Nishimura et al.

(10) Patent No.: US 10,726,727 B2
(45) Date of Patent: Jul. 28, 2020

(54) IN-VEHICLE DEVICE, INFORMATION PROCESSING SYSTEM, AND INFORMATION PROCESSING METHOD

(71) Applicant: TOYOTA JIDOSHA KABUSHIKI KAISHA, Toyota-shi, Aichi-ken (JP)

(72) Inventors: Kazuya Nishimura, Okazaki (JP); Yoshihiro Oe, Kawasaki (JP); Hirofumi Kamimaru, Fukuoka (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/153,174

(22) Filed: Oct. 5, 2018

(65) Prior Publication Data

US 2019/0130760 A1 May 2, 2019

(30) Foreign Application Priority Data

Oct. 26, 2017 (JP) ..... 2017-207248

(51) Int. Cl.
*G08G 1/16* (2006.01)

(52) U.S. Cl.
CPC ..... *G08G 1/167* (2013.01)

(58) Field of Classification Search
None
See application file for complete search history.

(56) References Cited

U.S. PATENT DOCUMENTS

2007/0088488 A1* 4/2007 Reeves ..... G07C 5/085 701/117
2007/0164852 A1* 7/2007 Litkouhi ..... B60G 17/0195 340/435
2009/0212930 A1* 8/2009 Pfeiffer ..... B60Q 9/008 340/435
2010/0315217 A1 12/2010 Miura et al.
2014/0309884 A1* 10/2014 Wolf ..... B60T 8/17 701/41
2015/0375748 A1 12/2015 Nagase et al.
2016/0101785 A1 4/2016 Takahashi et al.
2018/0251129 A1* 9/2018 Ji ..... B60W 30/0953

FOREIGN PATENT DOCUMENTS

JP 2005149402 A 6/2005
JP 2008110695 A 5/2008
JP 2008250492 A 10/2008

(Continued)

*Primary Examiner* — Thomas S McCormack
(74) *Attorney, Agent, or Firm* — Hunton Andrews Kurth LLP

(57) ABSTRACT

An in-vehicle device includes first circuitry configured to: detect that a predetermined lane change has been made in a vehicle; acquire information indicating acceleration of the vehicle, the acceleration being an acceleration at a time when the lane change is made; judge a traveling environment of the vehicle, the traveling environment being a traveling environment when the lane change is made; decide a first risk level by comparing the information indicating the acceleration acquired by the first circuitry with one or more first threshold values; and determine a risk level of the lane change using the first risk level decided by the first circuitry and the traveling environment of the vehicle judged by the first circuitry.

14 Claims, 15 Drawing Sheets

(56) References Cited

FOREIGN PATENT DOCUMENTS

| | | | |
|---|---|---|---|
| JP | 2008262401 | A | 10/2008 |
| JP | 2010238053 | A | 10/2010 |
| JP | 2010287162 | A | 12/2010 |
| JP | 2015022124 | A | 2/2015 |
| JP | 2016011030 | A | 1/2016 |
| JP | 2016081086 | A | 5/2016 |

* cited by examiner

FIG. 10A

1001

| THRESHOLD VALUE (ACCELERATION) | RISK LEVEL |
|---|---|
| LESS THAN threshold1 | 0 |
| EQUAL TO OR GREATER THAN threshold1 AND LESS THAN threshold2 | 5 |
| EQUAL TO OR GREATER THAN threshold2 AND LESS THAN threshold3 | 30 |
| EQUAL TO OR GREATER THAN threshold3 | 80 |

FIG. 10B

1002

| EVENT | EXAMPLES OF DETECTION METHOD |
|---|---|
| STOP BY RED SIGNAL | DETECT RED SIGNAL BY ANALYZING IMAGE DATA IMAGED BY CAMERA |
| DETECT STOPPED VEHICLE | DETECT VEHICLE BY ANALYZING IMAGE DATA IMAGED BY CAMERA, AND DETECT THAT VEHICLE IS NOT MOVING |
| DETECT OBSTACLE | DETECT OBSTACLE ON ROAD BY ANALYZING IMAGE DATA IMAGED BY CAMERA |
| DETECT PEDESTRIAN ON ROAD | DETECT PERSON ON ROAD BY ANALYZING IMAGE DATA IMAGED BY CAMERA |

1400

| TIME-CONVERTED DISTANCE | RISK LEVEL |
|---|---|
| LESS THAN 1.5 SECONDS | 80 |
| EQUAL TO OR LONGER THAN 1.5 SECONDS AND LESS THAN 2.0 SECONDS | 30 |
| EQUAL TO OR LONGER THAN 2.0 SECONDS AND LESS THAN 3.0 SECONDS | 5 |
| EQUAL TO OR LONGER THAN 3.0 SECONDS | 0 |

IN-VEHICLE DEVICE, INFORMATION PROCESSING SYSTEM, AND INFORMATION PROCESSING METHOD

INCORPORATION BY REFERENCE

The disclosure of Japanese Patent Application No. 2017-207248 filed on Oct. 26, 2017 including the specification, drawings and abstract is incorporated herein by reference in its entirety.

BACKGROUND

1. Technical Field

The present disclosure relates to an in-vehicle device, an information processing system, and an information processing method.

2. Description of Related Art

An in-vehicle device that determines whether or not a driving operation of a driver who drives a vehicle, such as an automobile, is appropriate is known.

For example, there is known a driving assistance apparatus that determines that a vehicle traveling in the same lane as another vehicle in front has overtaken another vehicle using an overtaking lane and determines the risk level of the overtaking operation according to the speed of the vehicle at the time of overtaking (for example, refer to Japanese Unexamined Patent Application Publication No. 2010-287162 (JP 2010-287162 A)).

SUMMARY

In the technique disclosed in JP 2010-287162 A, the risk level of the overtaking operation is determined based on the lane change of the vehicle and the speed of the vehicle. Therefore, since the deceleration operation of the vehicle after overtaking, the traveling environment of the vehicle, and the like are not reflected, the risk level of the overtaking operation cannot be correctly determined in some cases.

The disclosure provides an in-vehicle device, an information processing system, and an information processing method capable of correctly determining the risk level of a predetermined lane change (hereinafter, also simply referred to as a "risk level").

A first aspect of the disclosure relates to an in-vehicle device including first circuitry. The first circuitry is configured to detect that a predetermined lane change has been made in a vehicle. The first circuitry is configured to acquire information indicating acceleration of the vehicle, the acceleration being an acceleration at a time when the lane change is made. The first circuitry is configured to judge a traveling environment of the vehicle, the traveling environment being a traveling environment when the lane change is made. The first circuitry is configured to decide a first risk level by comparing the information indicating the acceleration acquired by the first circuitry with one or more first threshold values. The first circuitry is configured to determine a risk level of the lane change using the first risk level decided by the first circuitry and the traveling environment of the vehicle judged by the first circuitry.

As described above, in a case where a predetermined lane change is made, the in-vehicle device can acquire information indicating the acceleration of the vehicle, decide the first risk level based on the deceleration operation of the vehicle after overtaking, and evaluate the validity of the decided first risk level according to the traveling environment of the vehicle. Therefore, according to the first aspect of the disclosure, in the in-vehicle device for determining the risk level of a predetermined lane change, it is possible to correctly determine the risk level of the lane change by reflecting the deceleration operation after the lane change, the traveling environment of the vehicle, and the like.

The in-vehicle device according to the first aspect of the disclosure, the first circuitry may be configured to acquire information indicating a distance between the vehicle and another vehicle, the distance being a distance when the lane change is made. The first circuitry may be configured to decide a second risk level by comparing the information indicating the distance acquired by the first circuitry with one or more second threshold values. The first circuitry may be configured to determine the risk level of the lane change by further using the second risk level decided by the first circuitry.

As described above, the in-vehicle device can more correctly determine the risk level of the lane change based on the information indicating the acceleration of the vehicle and the information indicating the distance between the vehicle and another vehicle.

A second aspect of the disclosure relates to an in-vehicle device including first circuitry. The first circuitry is configured to detect that a predetermined lane change has been made in a vehicle. The first circuitry is configured to acquire information indicating a distance between the vehicle and another vehicle, the distance being a distance when the lane change is made. The first circuitry is configured to judge a traveling environment of the vehicle, the traveling environment being a traveling environment when the lane change is made. The first circuitry is configured to decide a second risk level by comparing the information indicating the distance acquired by the first circuitry with one or more second threshold values. The first circuitry is configured to determine a risk level of the lane change using the second risk level decided by the first circuitry and the traveling environment of the vehicle judged by the first circuitry.

As described above, in a case where a predetermined lane change is made, the in-vehicle device can acquire information indicating the distance between the vehicle and another vehicle, decide the second risk level based on the distance between the vehicle and another vehicle after overtaking, and evaluate the validity of the decided second risk level according to the traveling environment of the vehicle. Therefore, according to the second aspect of the disclosure, in the in-vehicle device for determining the risk level of a predetermined lane change, it is possible to correctly determine the risk level of the lane change by reflecting the distance between the vehicle and another vehicle after the lane change, the traveling environment of the vehicle, and the like.

The in-vehicle device according to the first or second aspect of the disclosure, the first circuitry may be configured to acquire image data obtained by imaging periphery of the vehicle. The first circuitry may be configured to detect a predetermined event around the vehicle by analyzing the image data acquired by the first circuitry. The first circuitry may be configured to stop risk level decision processing of the first circuitry or invalidate the risk level decided by the first circuitry when the first circuitry detects the predetermined event.

As described above, the in-vehicle device can prevent the first risk level from being added to the risk level of the lane change in a case where the first circuitry detects a predetermined event.

In the in-vehicle device according to the first or second aspect of the disclosure, the predetermined event may include detection of a red light, a pedestrian, or an obstacle in front of the vehicle.

As described above, in a case where a red light, a pedestrian, an obstacle, or the like is detected in front of the vehicle, the in-vehicle device can judge that rapid deceleration of the vehicle is inevitable and prevent the first risk level from being added to the risk level of the lane change.

In the in-vehicle device according to the first or second aspect of the disclosure, the predetermined lane change may include a lane change in a case where the vehicle traveling in the same lane as another vehicle in front overtakes another vehicle using an overtaking lane or a lane change in a case where the vehicle traveling on another lane adjacent to another vehicle passes another vehicle from the side.

As described above, for a lane change for the vehicle to overtake another vehicle or a lane change for the vehicle to pass another vehicle, the in-vehicle device can correctly determine the risk level of the lane change.

In the in-vehicle device according to the first or second aspect of the disclosure, the predetermined lane change may include a lane change in which the vehicle moves forward or backward with respect to another vehicle.

As described above, for a lane change for the vehicle to merge into the lane where other vehicles are traveling or a lane change in a case where the vehicle cuts in the lane where other vehicles are traveling, the in-vehicle device can correctly determine the risk level of the lane change.

The in-vehicle device according to the first or second aspect of the disclosure may further include a transmission unit configured to transmit determination information including a determination result of the first circuitry to an information processing apparatus that is linked with a predetermined service provided to a user of the vehicle.

Therefore, the information processing apparatus can link the risk level of the lane change determined by the in-vehicle device with a predetermined service provided to the user of the vehicle in which the in-vehicle device is mounted.

A third aspect of the disclosure relates to an information processing system including the in-vehicle device according to the first or second aspect of the disclosure and an information processing apparatus configured to communicate with the in-vehicle device through a network. The information processing apparatus includes a receiver and second circuitry. The receiver is configured to receive determination information, which is transmitted from the in-vehicle device and includes a determination result of a risk level of a lane change by a vehicle in which the in-vehicle device is mounted. The second circuitry is configured to manage one or more pieces of the determination information received by the receiver by storing the pieces of the determination information in a storage unit. The second circuitry is configured to link one or more pieces of the determination information managed by the second circuitry with the predetermined service provided to the user.

Therefore, the information processing system can link the risk level of the lane change determined by the in-vehicle device with a predetermined service provided to the user of the vehicle in which the in-vehicle device is mounted.

A fourth aspect of the disclosure relates to an information processing method. The information processing method includes: detecting that a predetermined lane change has been made in a vehicle by using a computer; acquiring information indicating acceleration of the vehicle, the acceleration being an acceleration at a time when the lane change is made by using the computer; judging a traveling environment of the vehicle, the traveling environment being a traveling environment when the lane change is made by using the computer; deciding a first risk level by comparing the acquired information indicating the acceleration with one or more threshold values by using the computer; and determining a risk level of the lane change using the decided first risk level and the judged traveling environment of the vehicle by using the computer.

According to the aspect of the disclosure, in the in-vehicle device for determining the risk level of a predetermined lane change, it is possible to correctly determine the risk level of the lane change by reflecting the deceleration operation after the lane change, the traveling environment of the vehicle, and the like.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 10A is a table showing examples of a threshold value of the acceleration according to the first embodiment and a predetermined event;

FIG. 10B is a table showing examples of a threshold value of the acceleration according to the first embodiment and a predetermined event;

DETAILED DESCRIPTION OF EMBODIMENTS

Hereinafter, embodiments for carrying out the disclosure will be described with reference to the diagrams.

System Configuration

Figure 1:
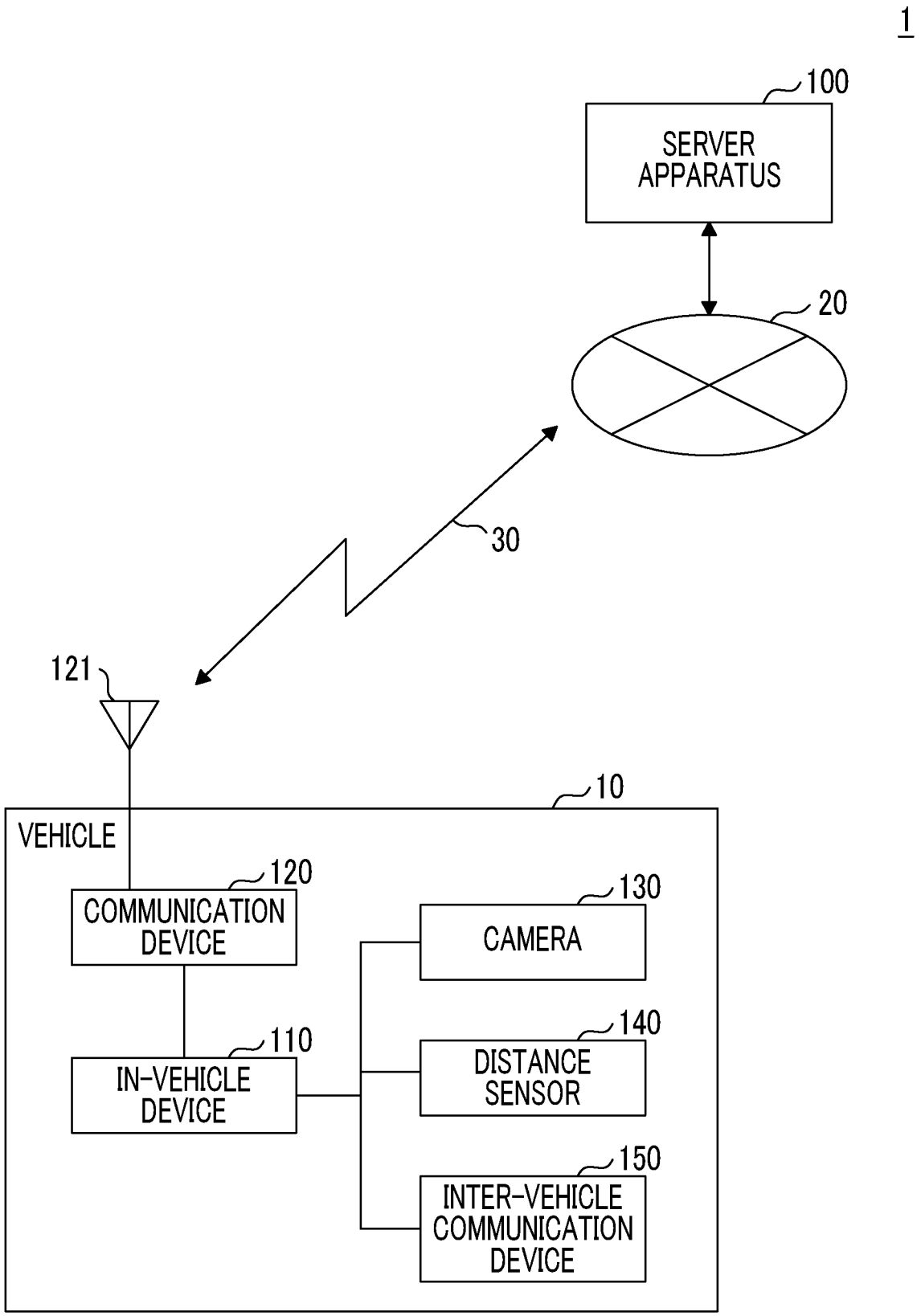
FIG. 1 is a diagram showing an example of the system configuration of an information processing system according to an embodiment of the disclosure.

FIG. 1 is a diagram showing an example of the system configuration of an information processing system according to an embodiment of the disclosure. An information processing system 1 is mounted in a vehicle 10, such as an automobile, and includes an in-vehicle device 110 that detects that a predetermined lane change has been made in the vehicle 10 and determines the risk level of the lane change. Overtaking, passing, merging, interruption, and the like by the vehicle 10 are examples of the predetermined lane change. Here, the following description will be given on the assumption that the predetermined lane change is overtaking. However, the scope of the disclosure is not limited.

Desirably, as shown in FIG. 1, the information processing system 1 includes a server apparatus 100 connected to a communication network 20. In the example shown in FIG. 1, the in-vehicle device 110 is connected to the communication network 20 using a communication device 120, and can communicate with the server apparatus 100 through the communication network 20. Here, the communication device 120 is a device for connection to the communication network 20 by wireless communication. For example, the communication device 120 is realized by a data communication module (DCM).

The in-vehicle device 110 is, for example, an information device such as a car navigation device or an information processing device such as an electronic control unit (ECU), which is mounted in the vehicle 10. The in-vehicle device 110 can acquire image data (for example, moving image data) obtained by imaging the periphery of the vehicle 10 using a camera 130 mounted in the vehicle 10. The in-vehicle device 110 can acquire vehicle information, such as a vehicle speed, a steering angle, and a brake pressure, from a vehicle control ECU that controls the vehicle 10 or the like.

Desirably, the in-vehicle device 110 can acquire the distance between the vehicle 10 and another vehicle around the vehicle 10, position information indicating the position of another vehicle, and the like using a distance sensor 140 mounted in the vehicle 10 or an inter-vehicle communication device 150 for communication with another vehicle.

With the configuration described above, for example, the in-vehicle device 110 detects that overtaking (an example of the predetermined lane change) has been performed in the vehicle 10 by analyzing image data of the periphery of the vehicle 10 captured by using the camera 130, and determines the risk level of the overtaking operation.

For example, in a case where it is detected that overtaking has been performed in the vehicle 10, the in-vehicle device 110 acquires information indicating the acceleration of the vehicle 10, and decides a first risk level indicating the risk level of the driving operation by comparing the acquired information indicating the acceleration with one or more threshold values. As an example, the in-vehicle device 110 stores a threshold value for judging that the vehicle 10 has decelerated rapidly in advance. In a case where a predetermined lane change is made, the in-vehicle device 110 adds a predetermined value to the first risk level indicating the risk level of the driving operation in a case where the acceleration of the vehicle 10 exceeds the threshold value.

Here, the first risk level is an example of information indicating the risk level of the driving operation, which is decided based on the information indicating the acceleration of the vehicle 10.

In a case where it is detected that overtaking has been performed in the vehicle 10, the in-vehicle device 110 judges the traveling environment of the vehicle 10 from the image data obtained by imaging the periphery of the vehicle 10 with the camera 130. For example, the in-vehicle device 110 judges whether or not there is a predetermined event (for example, detection of a red light, a pedestrian, or an obstacle) in front of the vehicle 10.

The in-vehicle device 110 determines the risk level of the overtaking operation performed by the vehicle 10 using the first risk level indicating the risk level of the driving operation and the traveling environment of the vehicle 10.

For example, in a case where a predetermined event is detected in front of the vehicle 10, the in-vehicle device 110 judges that the deceleration operation of the vehicle 10 is appropriate, and invalidates the decided first risk level (or stops the first risk level decision processing). On the other hand, in a case where a predetermined event is not detected in front of the vehicle 10, the in-vehicle device 110 validates the decided first risk level, and determines the first risk level as the risk level of the overtaking operation, for example.

In the above example, the in-vehicle device 110 can correctly determine the risk level of lane change by deciding the risk level at the time of overtaking based on the information indicating the acceleration of the vehicle 10 and judging the validity of the decided risk level based on the traveling environment of the vehicle 10.

Desirably, the in-vehicle device 110 transmits determination information including the determination result of the risk level of the overtaking operation to the server apparatus 100 through the communication device 120.

The server apparatus (information processing apparatus) 100 is, for example, a system including information processing apparatus, such as a personal computer (PC), or a plurality of information processing apparatuses. The server apparatus 100 can manage one or more pieces of determination information transmitted from the in-vehicle device 110 by storing the pieces of determination information in a storage unit, and can link one or more pieces of determination information under management with a predetermined service provided to a user (for example, a driver) of the vehicle 10 in which the in-vehicle device 110 is mounted.

As an example, in the server apparatus 100, an application method can be considered, such as reflecting one or more pieces of determination information transmitted from the in-vehicle device 110 on a point indicating the risk level of the driving diagnosis service for diagnosing the driving of the user of the vehicle 10 and giving an incentive to the user according to the point.

As another example, in the server apparatus 100, an application method can be considered, such as linking one or more pieces of determination information transmitted from the in-vehicle device 110 with the insurance service of the user of the vehicle 10 and lowering the insurance premium according to a point indicating the risk level in a predetermined period.

The in-vehicle device 110 may transmit determination information including the determination result of the risk level of the overtaking operation to an information processing apparatus, a display device, or the like mounted in the vehicle 10.

In the related art shown in JP 2010-287162 A, the risk level of the overtaking operation is determined based on the lane change of the vehicle and the speed of the vehicle. Therefore, since the deceleration operation of the vehicle after overtaking, the traveling environment of the vehicle, and the like are not reflected, the risk level of the overtaking operation cannot be correctly determined in some cases.

For example, in a case where the vehicle dangerously overtakes another vehicle from the right lane and then decelerates rapidly because there is a low-speed vehicle ahead, the overtaking operation is considered to have a high risk level. In the related art, however, the overtaking operation cannot be judged as a dangerous overtaking operation.

Even in a case where the vehicle overtakes another vehicle and then decelerates rapidly, the deceleration operation may be appropriate depending on the traveling environment of the vehicle, such as a case where the signal light turns red or a case where a pedestrian appears suddenly. In the related art, however, it is not possible to reflect the above-described traveling environment of the vehicle in the determination result of the risk level of the overtaking operation.

As described above, in the related art, it is difficult for the in-vehicle device mounted in the vehicle to correctly determine the risk level of the overtaking operation of the vehicle. The problem described above is not limited to the in-vehicle device that determines the risk level of the overtaking operation in the vehicle, and is commonly present in in-vehicle devices that determine the risk level of various lane changes, such as passing, merging, and interruption by a vehicle.

On the other hand, according to the first embodiment, in the in-vehicle device 110 for determining the risk level of a predetermined lane change, it is possible to correctly determine the risk level of the lane change by reflecting the deceleration operation after the lane change, the traveling environment of the vehicle 10, and the like.

Hardware Configuration

Hardware Configurations of In-Vehicle Device and Server Apparatus

Since each of the in-vehicle device 110 and the server apparatus 100 is an information processing apparatus having a configuration of a general computer, the hardware configuration of the general computer will be described herein.

Figure 2:
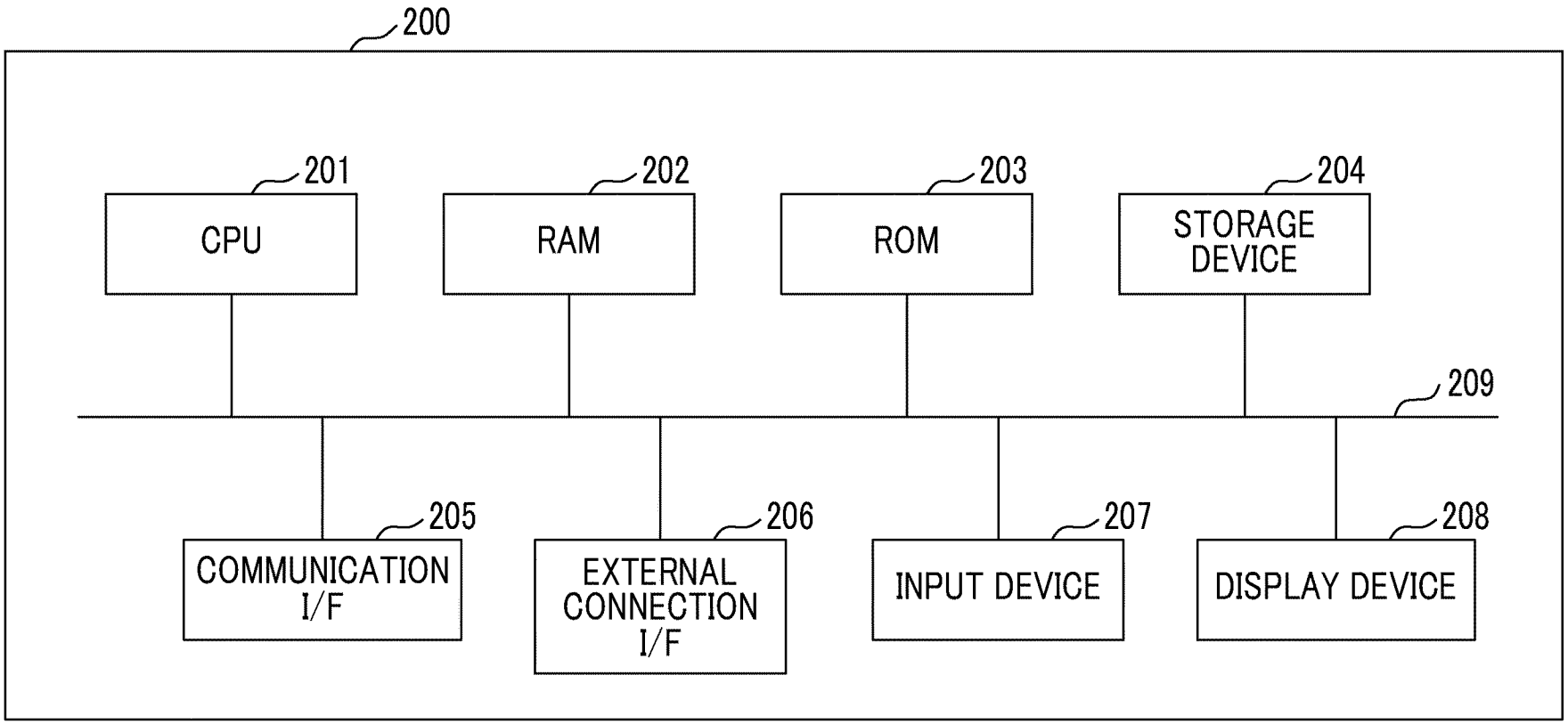
FIG. 2 is a diagram showing an example of the hardware configuration of a computer according to an embodiment of the disclosure.

FIG. 2 is a diagram showing an example of the hardware configuration of a computer according to an embodiment of the disclosure. A computer 200 includes, for example, a central processing unit (CPU) 201, a random access memory (RAM) 202, a read only memory (ROM) 203, a storage device 204, a communication interface (I/F) 205, an external connection I/F 206, an input device 207, a display device 208, and a system bus 209.

The CPU 201 is an arithmetic unit that realizes each function of the computer 200 by reading a program, data, or the like stored in the ROM 203, the storage device 204, or the like into the RAM 202 and executing processing. The RAM 202 is a volatile memory used as a work area of the CPU 201 or the like. The ROM 203 is a non-volatile memory that holds a program or data even in a case where the power is turned off. The storage device 204 is a storage device, such as a hard disk drive (HDD) or a solid state drive (SSD), and stores, for example, an operation system (OS), a program, and various data.

The communication I/F 205 is an interface through which the computer 200 communicates with another information processing apparatus or the like. For example, in a case where the computer 200 is the server apparatus 100, the communication I/F 205 is a network interface, such as a wired or wireless local area network (LAN). In a case where the computer 200 is the in-vehicle device 110, the communication I/F 205 is a communication interface, such as an in-vehicle ECU mounted in the vehicle 10 or a controller area network (CAN) for communicating with the communication device 120 or the like, for example.

The external connection I/F 206 is an interface for connecting an external device to the computer 200. Examples of the external device include a recording medium. In a case where the computer 200 is the in-vehicle device 110, the external device may be the camera 130, the distance sensor 140, the inter-vehicle communication device 150, and the like.

The input device 207 is an input device such as a keyboard, a touch panel, and an operation button for receiving an input operation of the user. The display device 208 is a display device for displaying processing results of the computer 200 and the like. The system bus 209 is commonly connected to each of the above-described components to transmit, for example, an address signal, a data signal, and various control signals.

The hardware configuration of the computer 200 shown in FIG. 2 is an example. For example, the computer 200 may not have the input device 207, the display device 208, and the like.

First Embodiment

The functional configuration of the information processing system 1 according to a first embodiment will be described.

Functional Configuration

Figure 3:
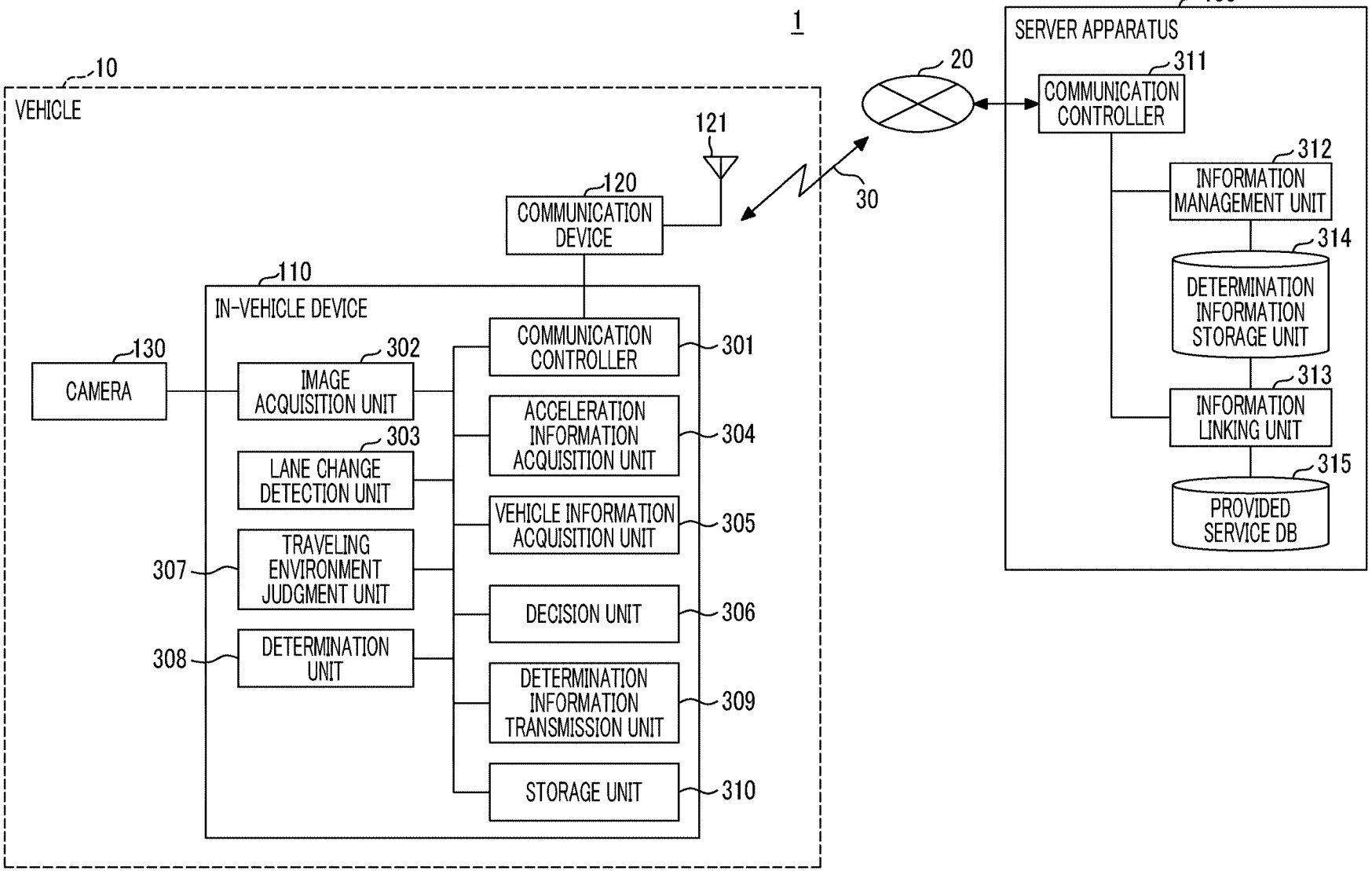
FIG. 3 is a diagram showing an example of the functional configuration of an information processing system according to a first embodiment.

FIG. 3 is a diagram showing an example of the functional configuration of the information processing system according to the first embodiment.

Functional Configuration of In-Vehicle Device

The in-vehicle device 110 has, for example, a communication controller 301, an image acquisition unit 302, a lane change detection unit 303, an acceleration information acquisition unit 304, a vehicle information acquisition unit 305, a decision unit 306, a traveling environment judgment unit 307, a determination unit 308, a determination information transmission unit 309, a storage unit 310, and the like.

For example, the in-vehicle device 110 realizes the above-described functional configuration by executing a program stored in a recording medium, such as the ROM 203 or the storage device 204, by the CPU 201. At least some of the above functional configurations may be realized by hardware.

The communication controller 301 is realized by, for example, a program executed by the CPU 201, and connects the in-vehicle device 110 to the communication network 20 using the communication device 120 to perform communication with the server apparatus 100 and the like. The communication device 120 is a wireless communication device, a wireless communication module, or the like that performs wireless communication using one or more antennas 121 provided in the vehicle 10 or the communication device 120 under the control of the communication controller 301.

The image acquisition unit 302 is realized by, for example, a program executed by the CPU 201, and acquires image data obtained by imaging the periphery of the vehicle 10 using the camera 130. For example, the image acquisition unit 302 acquires image data (for example, moving image data or one or more pieces of still image data) obtained by imaging the front of the vehicle 10 using the camera 130.

The lane change detection unit 303 is realized by, for example, a program executed by the CPU 201, and detects that a predetermined lane change has been made in the vehicle 10 by analyzing the image data acquired by the image acquisition unit 302. For example, the lane change detection unit 303 performs image processing on the image data acquired by the image acquisition unit 302, detects other vehicles traveling ahead or lanes, and detects a lane change, such as overtaking, passing, or merging, according to a predetermined algorithm. The lane change detection processing of the lane change detection unit 303 will be described later with reference to a flowchart.

The acceleration information acquisition unit (first information acquisition unit) 304 is realized by, for example, a program executed by the CPU 201, and acquires information indicating the acceleration of the vehicle 10 in a case where a predetermined lane change is made. For example, in a case where a predetermined lane change is detected by the lane change detection unit 303, the acceleration information acquisition unit 304 acquires information indicating the acceleration of the vehicle 10 (for example, the acceleration in the front-rear direction of the vehicle 10) from an acceleration sensor or the like provided in the vehicle 10 (or the in-vehicle device 110). The acceleration information acquisition unit 304 may acquire the information indicating the acceleration of the vehicle 10 from the vehicle control ECU that controls the vehicle 10 or the like using the vehicle information acquisition unit 305.

The vehicle information acquisition unit 305 is realized by, for example, a program executed by the CPU 201, and acquires vehicle information, such as a vehicle speed, a steering angle, an acceleration, and a brake pressure, from the vehicle control ECU that controls the vehicle 10, a sensor provided in the vehicle 10, or the like.

The decision unit 306 is realized by, for example, a program executed by the CPU 201, and decides the first risk level indicating the risk level of the driving operation by comparing the information indicating the acceleration of the vehicle 10 acquired by the acceleration information acquisition unit 304 with one or more first threshold values.

For example, in a case where the acceleration of the vehicle 10 in a case where a predetermined lane change is made exceeds a first threshold value set in advance, the decision unit 306 adds a predetermined value to the first risk level indicating the risk level of the driving operation. Here, it is assumed that, for example, a value for judging that the vehicle 10 has decelerated rapidly is set in advance as the first threshold value. The first risk level decision processing of the decision unit 306 will be described later with reference to a flowchart.

The traveling environment judgment unit (judgment unit) 307 is realized by, for example, a program executed by the CPU 201, and judges the traveling environment of the vehicle 10 in a case where a predetermined lane change is made. For example, the traveling environment judgment unit 307 judges whether or not there is a predetermined event (for example, detection of a red light, a pedestrian, or an obstacle) in front of the vehicle 10 by analyzing the image data acquired by the image acquisition unit 302. Here, as an example of the predetermined event, it is assumed that a sudden event, in which a rapid deceleration operation of the vehicle 10 is considered to be inevitable, is set in advance.

The determination unit 308 is realized by, for example, a program executed by the CPU 201, and determines the risk level of the predetermined lane change detected by the lane change detection unit 303 using the first risk level decided by the decision unit 306 and the traveling environment of the vehicle 10 judged by the traveling environment judgment unit 307.

For example, in a case where a predetermined event is detected in front of the vehicle 10, the determination unit 308 judges that the deceleration operation of the vehicle 10 is appropriate, and invalidates the decided first risk level (or stops the first risk level decision processing). On the other hand, in a case where a predetermined event is not detected in front of the vehicle 10, the determination unit 308 validates the decided first risk level, and determines the first risk level as the risk level of the overtaking operation, for example.

As another example, the determination unit 308 may determine the risk level by setting a basic point (for example, 10 points for a red light and 5 points for a pedestrian) in advance according to a predetermined event to be detected and adding the first risk level (for example, 10 points) to the basic point.

The determination information transmission unit 309 is realized by, for example, a program executed by the CPU 201, and transmits determination information including the determination result of the determination unit 308 to the server apparatus 100 using the communication controller 301. For example, in a case where the risk level of a predetermined lane change is determined by the determination unit 308, the determination information transmission unit 309 transmits determination information including the determination result of the determination unit 308 to the server apparatus 100 through the communication controller 301.

As another example, the determination unit 308 may sequentially store one or more determination results in the storage unit 310, and the determination information transmission unit 309 may transmit determination information including the determination result stored in the storage unit 310 to the server apparatus 100 every predetermined period.

The storage unit 310 is realized by, for example, the RAM 202 and the storage device 204, and stores a program executed by the CPU 201 and various kinds of information, such as threshold value information used in the decision unit 306 and determination results of the determination unit 308.

Functional Configuration of Server Apparatus

The server apparatus 100 includes, for example, a communication controller 311, an information management unit 312, an information linking unit 313, a determination information storage unit 314, and a provided service database (DB) 315. The provided service DB 315 may be realized by another information processing apparatus or the like provided outside the server apparatus 100.

The server apparatus 100 realizes each of the above-described functional configurations, for example, by a program executed by the CPU 201 (or a program executed by a plurality of computers 200).

The communication controller (receiver) 311 is realized by, for example, a program executed by the CPU 201, and functions as a receiver that receives determination information including the determination result of the risk level of the predetermined lane change in the vehicle 10, which is transmitted from the in-vehicle device 110.

The information management unit 312 is realized by, for example, a program executed by the CPU 201, and manages one or more pieces of determination information received by the communication controller 311 by storing the pieces of determination information in the determination information storage unit 314. For example, the information management unit 312 stores identification information for identifying the user of the vehicle 10 and determination information including the determination result of the risk level of the predetermined lane change, which are included in the determination information received by the communication controller 311, in the determination information storage unit 314 so as to be associated with each other.

The information linking unit 313 is realized by, for example, a program executed by the CPU 201, and links one or more pieces of determination information managed by the information management unit 312 with a service provided to the user of the vehicle 10.

For example, the information linking unit 313 links one or more pieces of determination information managed by the information management unit 312 with a driving diagnosis service for diagnosing the driving of the user of the vehicle 10, an insurance service subscribed to by the user of the vehicle 10, and the like.

Flow of Process

First Embodiment

A flow of the process of the information processing method according to the first embodiment will be described.

Process 1 of In-Vehicle Device

Figure 4:
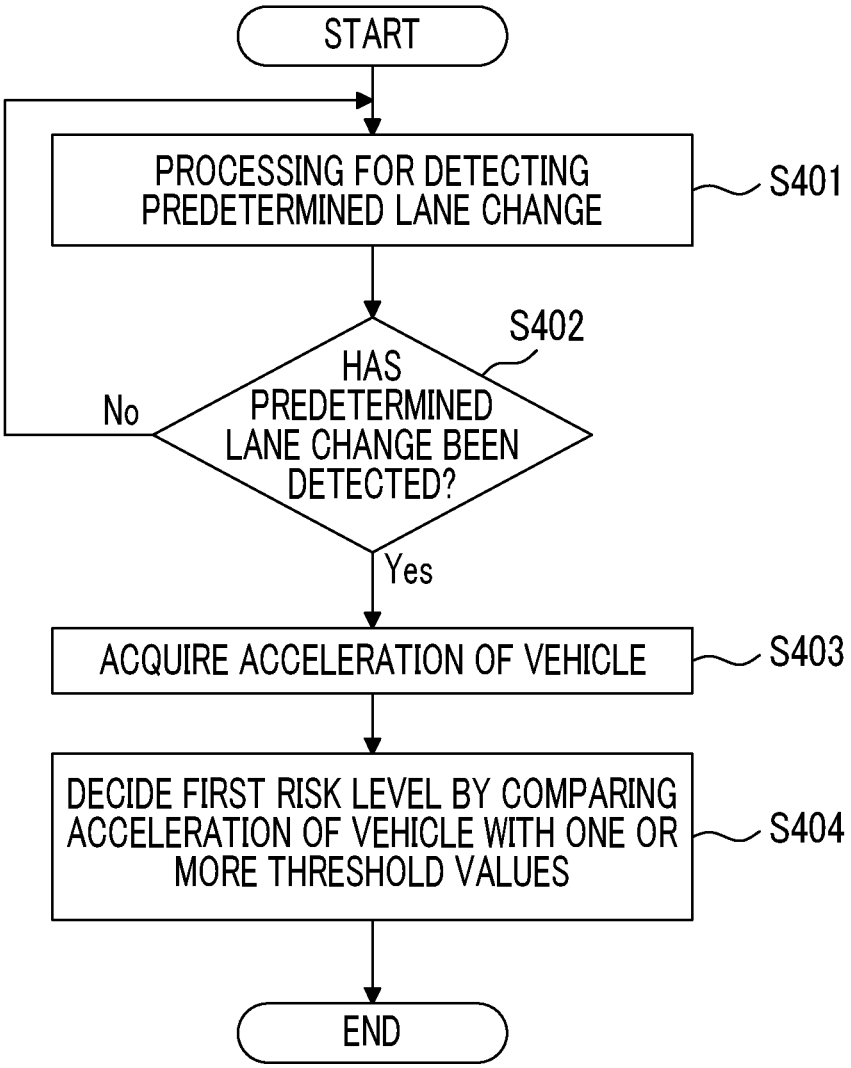
FIG. 4 is a flowchart showing the flow of a risk level determination process (1) according to the first embodiment.

FIG. 4 is a flowchart showing the flow of a risk level determination process (1) according to the first embodiment. The process in FIG. 4 shows an example of determination processing for determining the risk level of a predetermined lane change, which is executed by the in-vehicle device 110, while the vehicle 10 is traveling.

In step S401 (detection step), the lane change detection unit 303 of the in-vehicle device 110 executes detection processing for detecting a predetermined lane change. The predetermined lane change detection processing of the lane change detection unit 303 will be described later with reference to FIGS. 5A and 5B.

In step S402, the lane change detection unit 303 makes the processing branch according to whether or not a predetermined lane change has been detected in step S401. In a case where a predetermined lane change is detected, the lane change detection unit 303 proceeds to step S403. On the other hand, in a case where a predetermined lane change is not detected, the lane change detection unit 303 returns to step S401.

In step S403 (acquisition step), the acceleration information acquisition unit 304 of the in-vehicle device 110 acquires information indicating the acceleration of the vehicle 10. For example, the acceleration information acquisition unit 304 acquires the acceleration of the vehicle 10 from the vehicle control ECU that controls the vehicle 10 or the like using the vehicle information acquisition unit 305.

In step S404, the decision unit 306 of the in-vehicle device 110 decides the first risk level indicating the risk level of the driving operation by comparing the acceleration of the vehicle 10 acquired by the acceleration information acquisition unit 304 with one or more threshold values (first threshold values). The first risk level decision processing of the decision unit 306 will be described later with reference to FIGS. 6A to 10B.

Through the above processing, the in-vehicle device 110 can decide (determine) the first risk level (an example of the risk level of a predetermined lane change). The determination processing for determining the risk level of a predetermined lane change using the first risk level and the traveling environment of the vehicle 10 will be described later with reference to FIG. 11.

Lane Change Detection Process

Figure 5A:
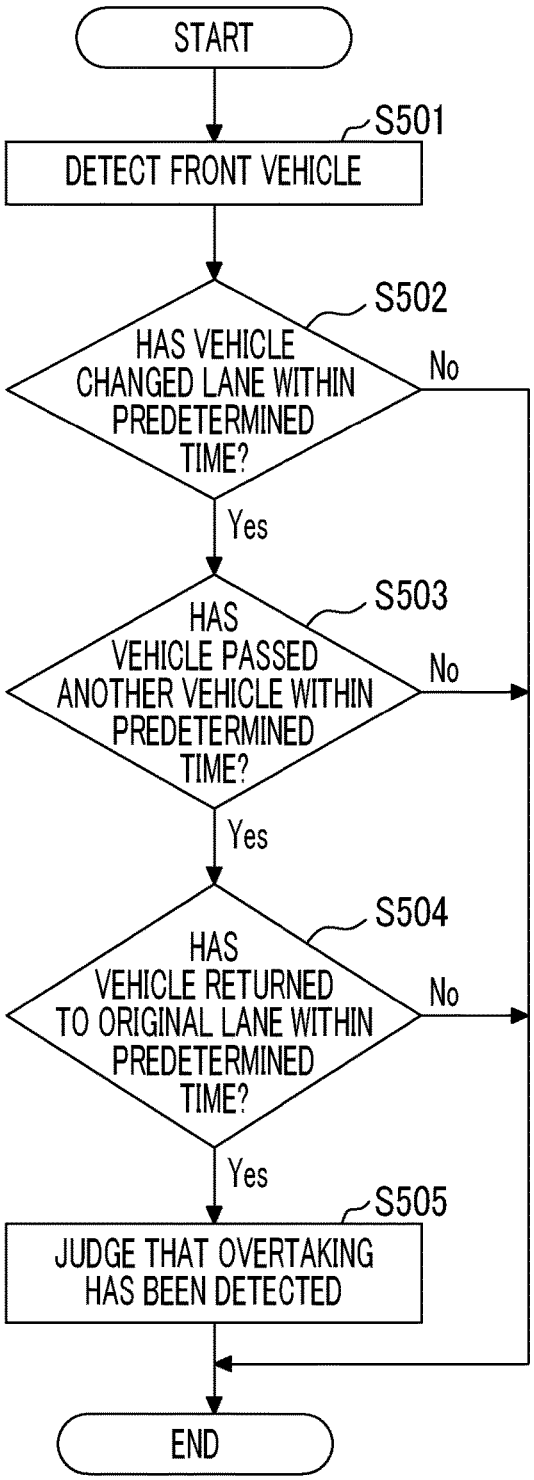
FIG. 5A is a flowchart showing an example of a lane change detection process according to the first embodiment.
Figure 5B:
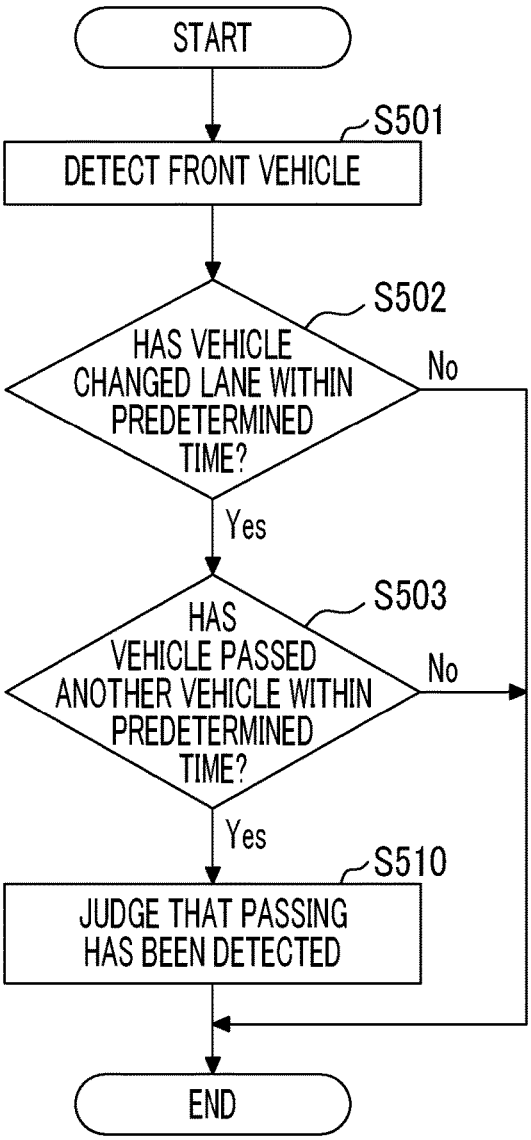
FIG. 5B is a flowchart showing an example of a lane change detection process according to the first embodiment.

FIGS. 5A and 5B are flowcharts showing examples of lane change detection processing according to the first embodiment. Respective processes shown in FIGS. 5A and 5B show examples of the processing of detecting a predetermined lane change shown in step S401 of FIG. 4.

FIG. 5A shows an example of the lane change detection processing in a case where the predetermined lane change is a lane change for the vehicle 10 to overtake another vehicle (hereinafter, simply referred to as "overtaking").

In step S501, the lane change detection unit 303 detects another vehicle traveling in front of the vehicle 10 by analyzing the image data acquired by the image acquisition unit 302, for example. For example, the lane change detection unit 303 performs image processing on the image data acquired by the image acquisition unit 302, and extracts another vehicle traveling ahead using a known pattern matching technique or the like.

In step S502, the lane change detection unit 303 judges whether or not the vehicle 10 has changed the lane within a predetermined time (first time) from the detection of the front vehicle, for example.

Figure 7A:
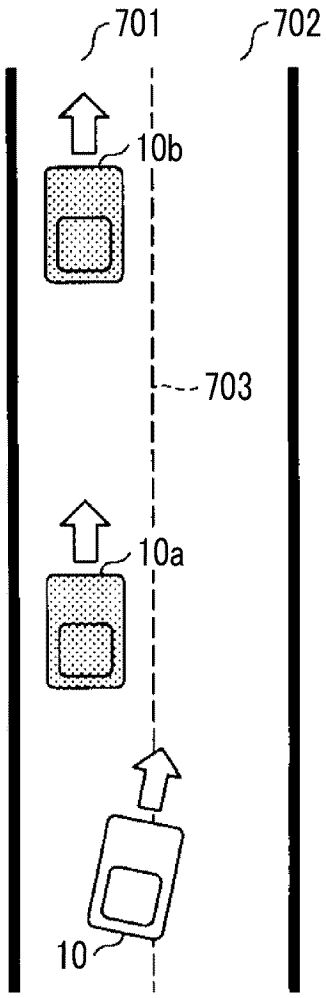
FIG. 7A is a diagram illustrating an example of overtaking according to the first embodiment.

For example, as shown in FIG. 7A, it is assumed that the vehicle 10 changes the lane from a travel lane 701 to an overtaking lane 702. In this case, the lane change detection unit 303 judges that the lane change has been made due to the fact that the vehicle 10 has moved to the overtaking lane 702 beyond a white line (or yellow line) 703 on the road by analyzing the image data obtained by imaging the front of the vehicle 10.

In a case where the lane change is not made within the predetermined time, the lane change detection unit 303 ends the lane change detection processing. On the other hand, in a case where a lane change is made within the predetermined time, the lane change detection unit 303 proceeds to step S503.

In step S503, the lane change detection unit 303 judges whether or not the vehicle 10 has passed another vehicle within a predetermined time (second time) after it is judged that the lane change has been made in step S502, for example.

Figure 7B:
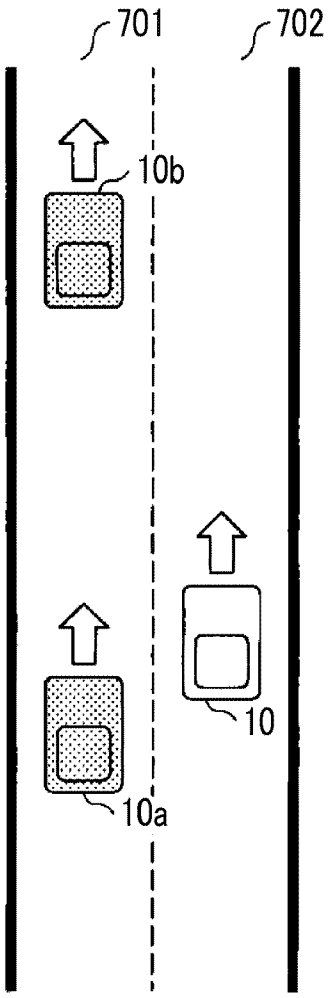
FIG. 7B is a diagram illustrating an example of overtaking according to the first embodiment.

For example, as shown in FIG. 7B, it is assumed that the vehicle 10 passes another vehicle 10*a*. In this case, for example, the lane change detection unit 303 judges that passing has been performed due to the fact that another vehicle 10*a* has moved from the left side within the imaging range of the image data to the outside of the imaging range by analyzing the image data obtained by imaging the front of the vehicle 10.

In a case where passing is not performed within the predetermined time, the lane change detection unit 303 ends the lane change detection processing. On the other hand, in a case where a lane change is made within the predetermined time, the lane change detection unit 303 proceeds to step S504.

In step S504, the lane change detection unit 303 judges whether or not the vehicle 10 has returned to the original lane within a predetermined time (third time) after the passing is performed in step S503, for example.

Figure 7C:
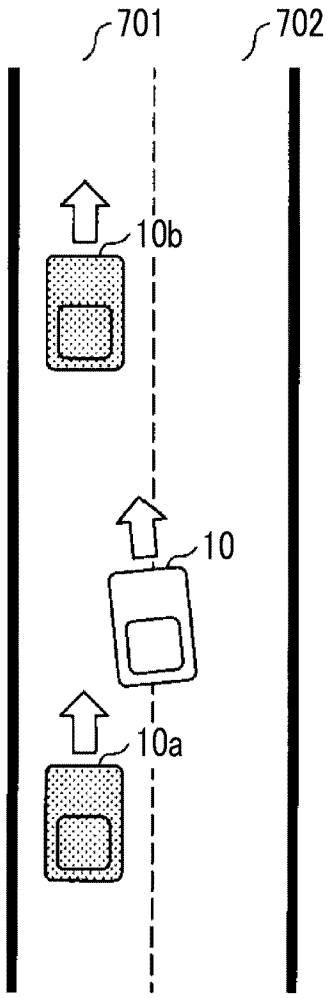
FIG. 7C is a diagram illustrating an example of overtaking according to the first embodiment.

For example, as shown in FIG. 7C, it is assumed that the vehicle 10 returns from the overtaking lane 702 to the travel lane 701. In this case, for example, the lane change detection unit 303 judges that the vehicle 10 has returned to the original lane due to the fact that the vehicle 10 has moved to the travel lane 701 beyond the white line 703 on the road by analyzing the image data obtained by imaging the front of the vehicle 10.

In a case where the vehicle 10 does not return to the original lane within the predetermined time, the lane change detection unit 303 ends the lane change detection processing. On the other hand, in a case where a lane change is made within the predetermined time, the lane change detection unit 303 proceeds to step S505.

In step S505, the lane change detection unit 303 judges that overtaking (an example of the predetermined lane change) has been detected.

Through the above processing, the lane change detection unit 303 can detect that the vehicle 10 has performed overtaking (lane change for overtaking another vehicle).

FIG. 5B shows an example of the lane change detection processing in a case where the predetermined lane change is a lane change for the vehicle 10 to pass another vehicle (hereinafter, simply referred to as "passing"). Since the contents of each process shown in steps S501 to S503 in FIG. 5B are the same as those in FIG. 5A, the detailed description thereof will be omitted herein.

In step S501, the lane change detection unit 303 detects another vehicle traveling in front of the vehicle 10 by analyzing the image data acquired by the image acquisition unit 302, for example.

In step S502, the lane change detection unit 303 judges whether or not the vehicle 10 has changed the lane within a predetermined time (first time) from the detection of the front vehicle, for example.

In a case where the lane change is not made within the predetermined time, the lane change detection unit 303 ends the lane change detection processing. On the other hand, in a case where the lane change is made within the predetermined time, the lane change detection unit 303 proceeds to step S503.

In step S503, the lane change detection unit 303 judges whether or not the vehicle 10 has passed another vehicle within a predetermined time (second time) after it is judged that the lane change has been made in step S502, for example.

In a case where passing is not performed within the predetermined time, the lane change detection unit 303 ends the lane change detection processing. On the other hand, in a case where a lane change is made within the predetermined time, the lane change detection unit 303 proceeds to step S510.

In step S510, the lane change detection unit 303 judges that passing (an example of the predetermined lane change) has been detected.

Through the above processing, the lane change detection unit 303 can detect that the vehicle 10 has performed passing (lane change for passing another vehicle).

First Risk Level Decision Process

Figure 6B:
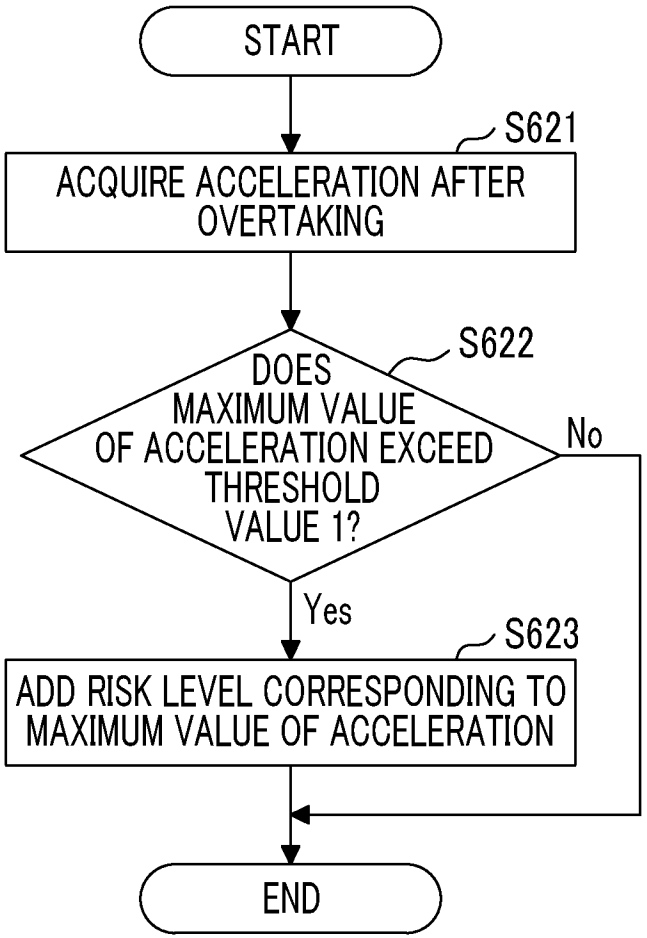
FIG. 6B is a flowchart showing an example of a risk level decision process according to the first embodiment.
Figure 6A:
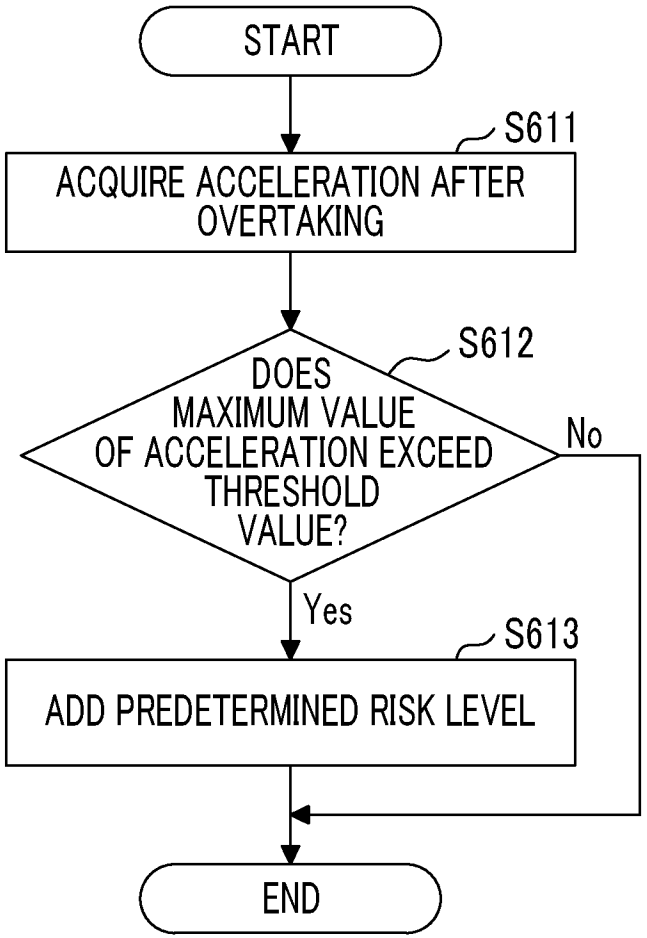
FIG. 6A is a flowchart showing an example of a risk level decision process according to the first embodiment.

FIGS. 6A and 6B are flowcharts showing examples of first risk level decision processing according to the first embodiment. Respective processes shown in FIGS. 6A and 6B show examples of the decision processing for deciding the first risk level by comparing the acceleration of the vehicle 10 with one or more threshold values, which is shown in step S404 of FIG. 4. As described above, the first risk level is an example of information indicating the risk level of the driving operation, which is decided based on the information indicating the acceleration of the vehicle 10.

FIG. 6A is a flowchart showing an example of the first risk level decision processing. Here, as an example, assuming that the predetermined lane change is "overtaking", the following description will be given.

In step S611, the decision unit 306 of the in-vehicle device 110 acquires acceleration after "overtaking" detected by the lane change detection unit 303 from the acceleration (an example of the information indicating acceleration) of the vehicle 10 acquired by the acceleration information acquisition unit 304.

Figure 7D:
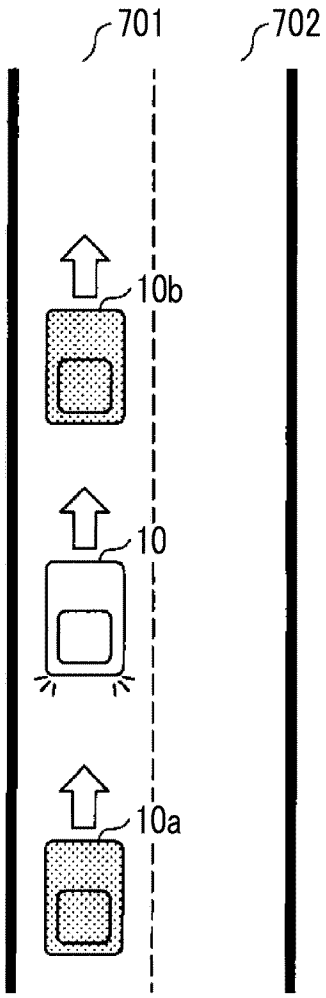
FIG. 7D is a diagram illustrating an example of overtaking according to the first embodiment.
Figure 8A:
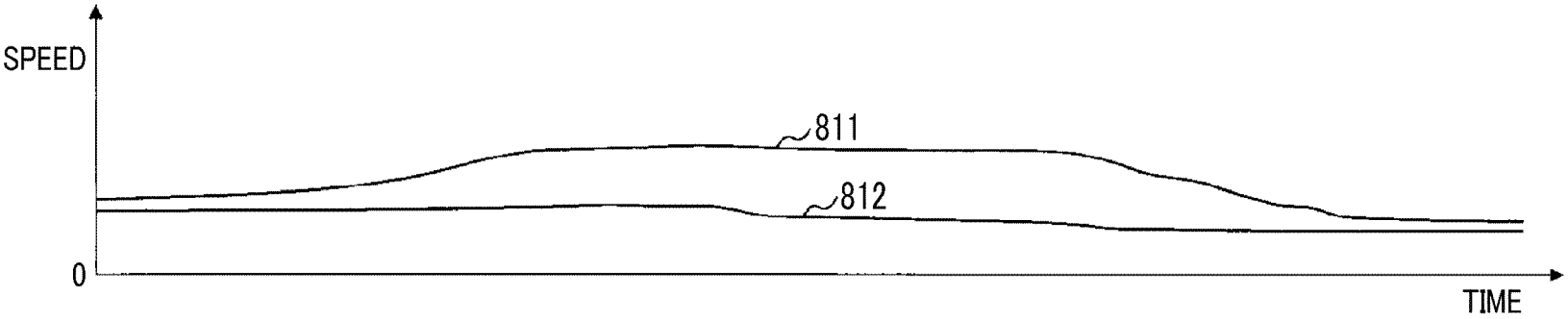
FIG. 8A is a graph showing an example of speed at the time of overtaking according to the first embodiment.
Figure 8B:
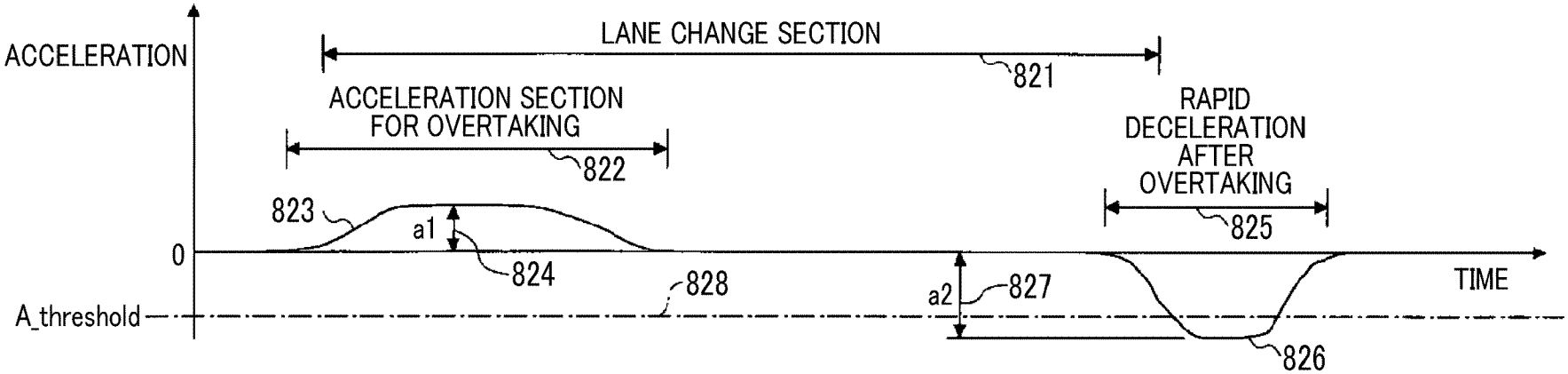
FIG. 8B is a graph showing an example of acceleration at the time of overtaking according to the first embodiment.

FIGS. 8A and 8B are graphs showing examples of the speed and the acceleration at the time of overtaking according to the first embodiment. FIG. 8A shows an example of changes in the speed 811 of the vehicle 10 and the speed 812 of the vehicle 10*a* in a case where the vehicle 10 overtakes the front vehicle 10*a* as shown in FIGS. 7A to 7D.

The example shown in FIG. 8A is an example of changes in the speed of the vehicles 10, 10*a* in a case where the vehicle 10 accelerates and overtakes the front vehicle 10*a* at a higher speed than the vehicle 10*a* and then decelerates due to the low-speed vehicle 10*b* in front, for example, as shown in FIG. 7D.

FIG. 8B shows an example of the acceleration of the vehicle 10 in a case where the vehicle 10 overtakes the front vehicle 10*a* as shown in FIGS. 7A to 7D.

For example, a section for the vehicle 10 to overtake the front vehicle 10*a* as shown in FIGS. 7A to 7C is assumed to be a lane change section 821. A section for the vehicle 10 to pass the front vehicle 10*a* as shown in FIGS. 7A and 7B is assumed to be an acceleration section for overtaking 822. In this case, in the acceleration section for overtaking 822, the vehicle 10 accelerates. Accordingly, for example, as shown in FIG. 8B, acceleration 823 in the positive direction is detected, and a maximum value 824 of the magnitude of the detected acceleration 823 is assumed to be "a1".

In addition, for example, as shown in FIG. 8B, a section in which the vehicle 10 decelerates after the latter half of the lane change section 821 is assumed to be a rapid deceleration after overtaking 825. In this case, in the rapid deceleration after overtaking 825, the vehicle 10 decelerates. Accordingly, for example, as shown in FIG. 8B, acceleration 826 in the negative direction is detected, and a maximum value 827 of the magnitude of the detected acceleration is assumed to be "a2".

In step S611 of FIG. 6A, the decision unit 306 of the in-vehicle device 110 acquires, for example, the acceleration 826 in the rapid deceleration after overtaking 825 shown in FIG. 8B.

In step S612 of FIG. 6A, the decision unit 306 of the in-vehicle device 110 judges whether or not the maximum value of the acceleration acquired in step S611 exceeds a threshold value (first threshold value).

For example, the decision unit 306 judges whether or not the value of "a2", which is the maximum value 827 of the acceleration 826 in the negative direction, in the rapid deceleration after overtaking 825 shown in FIG. 8B exceeds a first threshold value (A_threshold) 828. As described above, it is assumed that a value for judging that the vehicle 10 has decelerated rapidly is set in advance as the first threshold value.

In a case where the maximum value of the acceleration does not exceed the first threshold value, the decision unit 306 ends the first risk level decision processing. On the other hand, in a case where the maximum value of the acceleration exceeds the first threshold value, the decision unit 306 proceeds to step S613.

In step S613, the decision unit 306 of the in-vehicle device 110 adds a predetermined risk level to decide the first risk level.

The predetermined risk level is, for example, a score (for example, 1 point or 5 points) set in advance. The decision unit 306 adds a predetermined risk level to an initial value (for example, 0 points), for example.

As another example, the decision unit 306 may add a predetermined risk level to a basic score corresponding to the lane change type, the speed 811 of the vehicle 10, the maximum value "a1" of the acceleration in the acceleration section for overtaking 822, and the like.

Through the above processing, the decision unit 306 can decide the first risk level, which is an example of information indicating the risk level of the driving operation and is decided based on the information indicating the acceleration of the vehicle 10.

As described above, for example, in a case where the vehicle 10 performs overtaking as shown in FIGS. 7A to 7D, the decision unit 306 of the in-vehicle device 110 adds the first risk level as the risk level of the overtaking operation.

FIGS. 9A to 9E are diagrams and graphs illustrating another example of overtaking according to the first embodiment. FIGS. 9A to 9E show an example of an overtaking operation in which the first risk level is not added as the risk level of the overtaking operation.

Figure 9A:
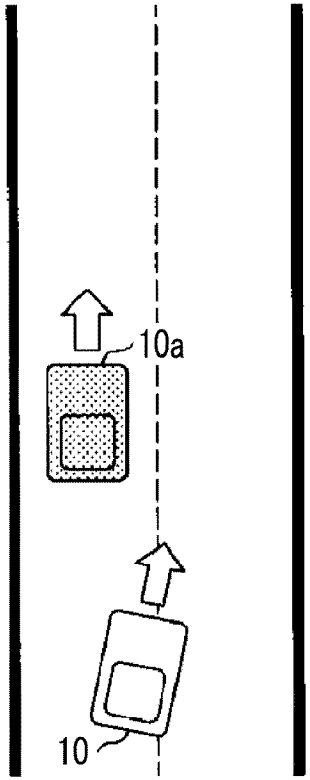
FIG. 9A is a diagram illustrating another example of overtaking according to the first embodiment.
Figure 9B:
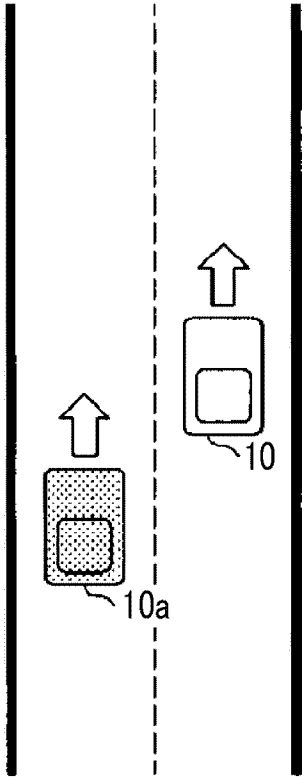
FIG. 9B is a diagram illustrating another example of overtaking according to the first embodiment.
Figure 9C:
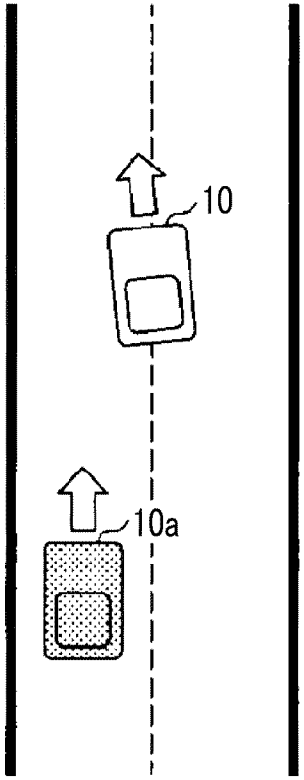
FIG. 9C is a diagram illustrating another example of overtaking according to the first embodiment.
Figure 9D:
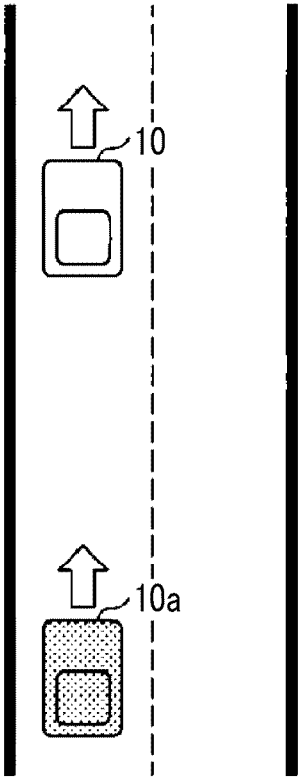
FIG. 9D is a diagram illustrating another example of overtaking according to the first embodiment.

For example, the vehicle 10 moves to the overtaking lane in order to overtake another vehicle 10*a* in FIG. 9A, and overtakes another vehicle 10*a* in FIG. 9B. The vehicle 10 returns to the travel lane in FIG. 9C, but it is assumed that the vehicle 10 does not decelerate rapidly since there is no low-speed vehicle 10*b* in front of the vehicle 10 in FIG. 9D.

Figure 9E:
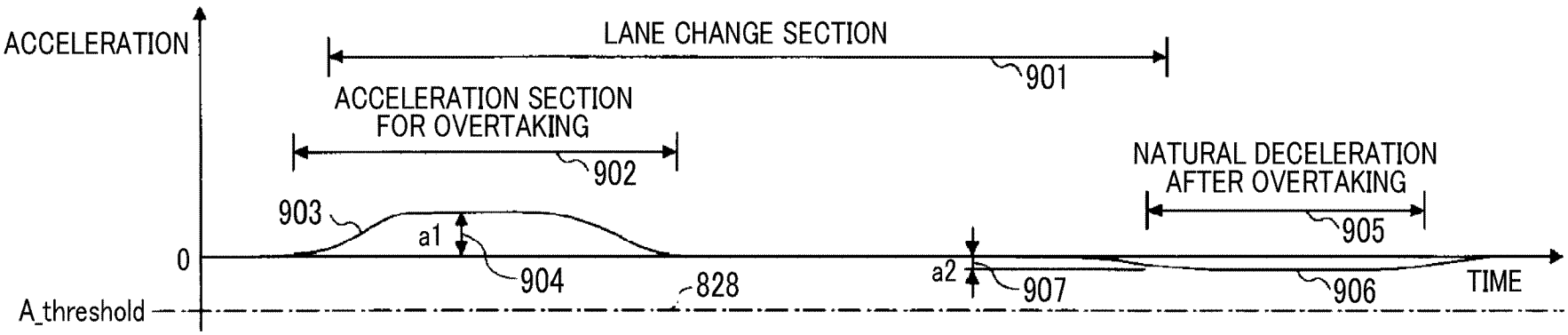
FIG. 9E is a graph illustrating another example of acceleration at the time of overtaking according to the first embodiment.

In this case, as shown in FIG. 9E, in an acceleration section for overtaking 902 in the first half of a lane change section 901, as in FIG. 8B, acceleration 903 in the positive direction is detected, and a maximum value 904 of the magnitude of the detected acceleration 903 is assumed to be "a1".

On the other hand, a section in which the vehicle 10 decelerates after the latter half of the lane change section 901 is assumed to be natural deceleration after overtaking 905. In this case, in the natural deceleration after overtaking 905, the vehicle 10 decelerates rapidly. Accordingly, for example, as shown in FIG. 9B, acceleration 906 in the negative direction is detected, and "a2" that is a maximum value 907 of the magnitude of the acceleration 906 does not exceed the first threshold value. Therefore, the decision unit 306 can stop adding the first risk level to the overtaking operation having a low risk level shown in FIGS. 9A to 9D.

The decision unit 306 may decide the first risk level by storing a plurality of first threshold values in advance and comparing information indicating the acceleration of the vehicle 10 with the first threshold values.

FIG. 6B is a flowchart showing another example of the first risk level decision processing. The process shown in FIG. 6B shows an example of processing in a case where the decision unit 306 decides the first risk level using a plurality of first threshold values. Here, the detailed description of the same processing contents similar to the process shown in FIG. 6A will be omitted.

In step S621, the decision unit 306 of the in-vehicle device 110 acquires acceleration after "overtaking" detected by the lane change detection unit 303 from the acceleration of the vehicle 10 acquired by the acceleration information acquisition unit 304. The processing of step S621 corresponds to the processing of step S611 in FIG. 6A.

In step S622, the decision unit 306 judges whether or not the maximum value of the acceleration acquired in step S621 exceeds a threshold value 1 (threshold1).

For example, the decision unit 306 stores correspondence information 1001 indicating the correspondence relationship between the first threshold values and the risk level, which is shown in FIG. 10A, in the storage unit 310, and judges whether or not the maximum value "a2" of the acceleration exceeds a threshold value 1 (threshold1) that is a minimum threshold value.

In a case where the maximum value of the acceleration does not exceed the threshold value 1, the decision unit 306 ends the first risk level decision processing. On the other hand, in a case where the maximum value of the acceleration exceeds the threshold value 1, the decision unit 306 proceeds to step S623.

In step S623, the decision unit 306 adds a risk level corresponding to the maximum value "a2" of the acceleration to decide the first risk level. For example, the decision unit 306 acquires a risk level corresponding to the maximum value "a2" of the acceleration using the correspondence information 1001 shown in FIG. 10A, and adds the acquired risk level to decide the first risk level.

In this case, as described above, the decision unit 306 may add the risk level to the initial value (for example, 0 points), or may add the risk level to the basic point based on other factors.

Through the above processing, the decision unit 306 of the in-vehicle device 110 can decide the first risk level by comparing the information indicating the acceleration of the vehicle 10 with a plurality of first threshold values.

Process 2 of In-Vehicle Device

Figure 11:
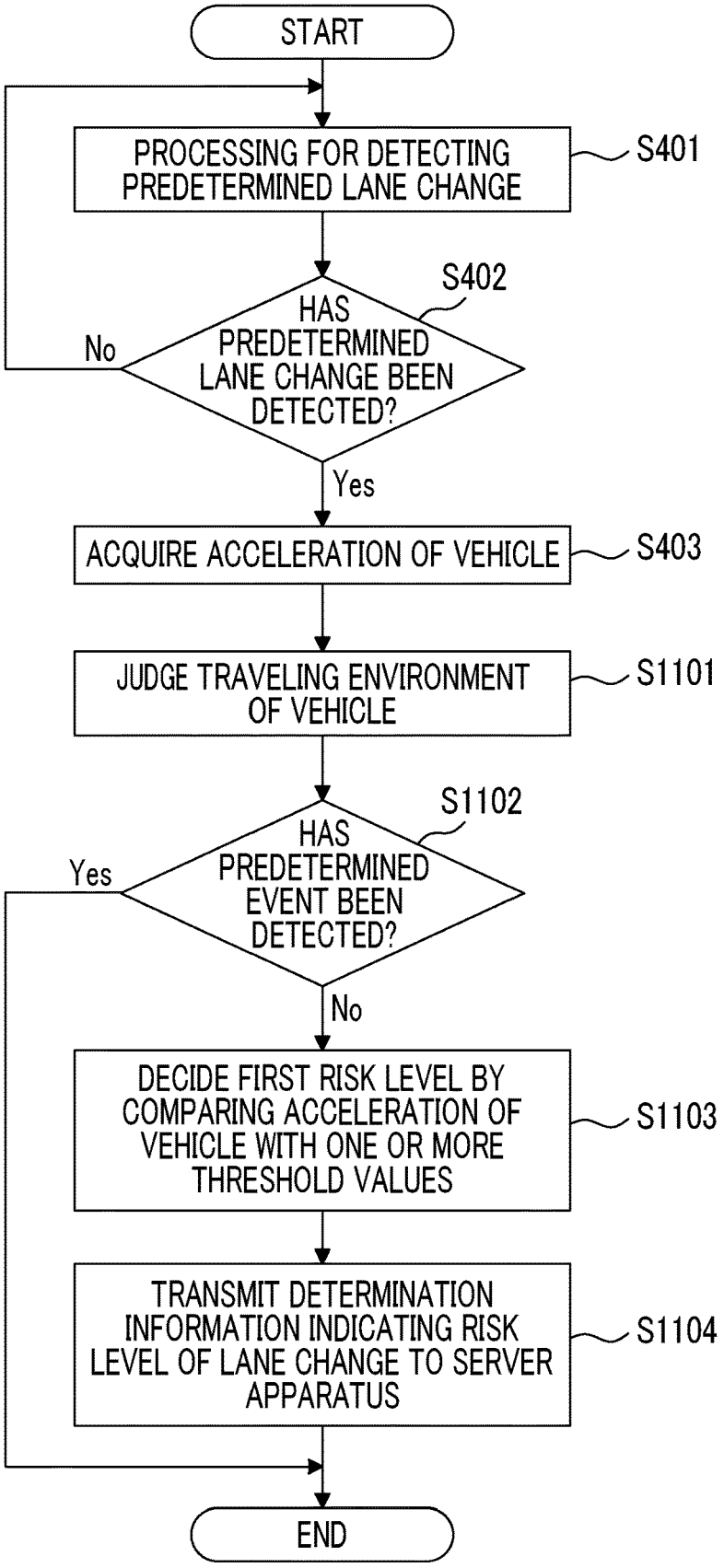
FIG. 11 is a flowchart showing the flow of a risk level determination process (2) according to the first embodiment.

FIG. 11 is a flowchart showing the flow of a risk level determination process (2) according to the first embodiment. The process shown in FIG. 11 shows an example of processing of the in-vehicle device 110 in the case of determining the risk level of a predetermined lane change using the first risk level and the traveling environment of the vehicle 10. Since the processing shown in steps S401 to S403 in the process shown in FIG. 11 is the same as the processing shown in FIG. 4, the following description will be focused on the differences from the process shown in FIG. 4 herein.

In step S1101 (judgment step), the traveling environment judgment unit 307 of the in-vehicle device 110 judges the traveling environment of the vehicle 10. For example, the traveling environment judgment unit 307 judges the presence or absence of a predetermined event in the front of the vehicle 10 by analyzing the image data acquired by the image acquisition unit 302. As described above, as the predetermined event, it is assumed that a sudden event, in which a rapid deceleration operation of the vehicle 10 is considered to be inevitable, is set in advance.

FIG. 10B shows an example of a predetermined event 1002. In the example shown in FIG. 10B, the predetermined event 1002 includes events, such as "stop by red light", "detect a stopped vehicle", "detect an obstacle", and "detect a pedestrian on a road".

"Stop by red light" is assumed, for example, in a case where the signal light turns red after the vehicle 10 overtakes another vehicle. For example, the traveling environment judgment unit 307 detects a red light by analyzing the image data acquired by the image acquisition unit 302.

"Detect a stopped vehicle" is assumed, for example, in a case where a vehicle stopped due to congestion, signal waiting, or the like is detected. For example, the traveling environment judgment unit 307 detects a vehicle that is not moving by analyzing the image data acquired by the image acquisition unit 302. Examples of the stopped vehicle may include (may not include) a vehicle parked on a road or a vehicle at a stop.

"Detect an obstacle" is assumed, for example, in a case where an object other than a vehicle, such as a falling object on the road, is detected. For example, the traveling environment judgment unit 307 detects an object on the road by analyzing the image data acquired by the image acquisition unit 302.

"Detect a pedestrian on a road" is assumed, for example, in a case where a pedestrian is detected on the road after the vehicle 10 overtakes another vehicle. For example, the traveling environment judgment unit 307 detects a person on the road by analyzing the image data acquired by the image acquisition unit 302.

The predetermined events shown in FIG. 10B are examples, and may include an event different from the events shown in FIG. 10B or may not include some of the events shown in FIG. 10B.

Returning to FIG. 11, the description of the flowchart will be continued.

In step S1102, the determination unit 308 of the in-vehicle device 110 determines whether or not a predetermined event has been detected by the traveling environment judgment unit 307.

In a case where a predetermined event is detected, the determination unit 308 stops the risk level decision processing of the decision unit 306, and ends the risk level determination processing. On the other hand, in a case where no predetermined event is detected, the traveling environment judgment unit 307 proceeds to step S1103.

The processing of step S1102 is an example of determination step in which the determination unit 308 determines the risk level of a predetermined lane change using the first risk level decided by the decision unit 306 and the traveling environment of the vehicle 10 judged by the traveling environment judgment unit 307.

The processing of step S1102 may be executed after step S1103. In this case, in a case where a predetermined event is detected, the determination unit 308 invalidates the first risk level decided by the decision unit 306.

As described above, in the determination step, in a case where the traveling environment judgment unit 307 detects a predetermined event, the determination unit 308 stops the risk level decision processing of the decision unit 306 or invalidates the risk level of the lane change decided by the decision unit 306.

As described above, as a predetermined event, a sudden event in which a rapid deceleration operation of the vehicle 10 is considered to be inevitable is set in advance. Therefore, the determination unit 308 can prevent the first risk level from being added to the risk level of the lane change by an inevitable rapid deceleration operation.

In step S1103 (decision step), the decision unit 306 of the in-vehicle device 110 decides the first risk level indicating the risk level of the driving operation by comparing the acceleration of the vehicle 10 acquired by the acceleration information acquisition unit 304 with one or more first threshold values. For example, the decision unit 306 decides the first risk level by the first risk level decision processing shown in FIG. 6A or 6B.

For example, by the processing of steps S1102 and S1103, the determination unit 308 can determine the risk level of a predetermined lane change using the first risk level decided by the decision unit 306 and the traveling environment of the vehicle 10 judged by the traveling environment judgment unit 307.

Here, the risk level of the lane change determined by the determination unit 308 may be the first risk level decided by the decision unit 306. As another example, the risk level of the lane change determined by the determination unit 308 may be information obtained by adding the first risk level to the basic point or the like corresponding to the predetermined event detected in step S1101.

In step S1104, the determination information transmission unit 309 of the in-vehicle device 110 transmits the determination information including the risk level of the lane change, which is determined in steps S1102 and S1103, to the server apparatus 100 through the communication controller 301.

Through the above processing, in a case where a predetermined lane change is made, the in-vehicle device 110 acquires information indicating the acceleration of the vehicle 10, and decides a first risk level indicating the risk level of the driving operation by comparing the acceleration of the vehicle 10 in a case where overtaking is performed with one or more first threshold values. The in-vehicle device 110 judges the traveling environment of the vehicle 10, and stops the first risk level decision processing or invalidates the decided first risk level in a case where a predetermined event is detected.

Therefore, according to the first embodiment, in the in-vehicle device 110 for determining the risk level of a predetermined lane change, it is possible to correctly determine the risk level of the lane change by reflecting the deceleration operation after the lane change, the traveling environment of the vehicle 10, and the like.

Second Embodiment

In the first embodiment, the decision unit 306 of the in-vehicle device 110 decides the first risk level by comparing the acceleration of the vehicle 10 with one or more first threshold values. However, the acceleration of the vehicle 10 is an example of the information indicating the acceleration of the vehicle 10. For example, the decision unit 306 may decide the first risk level using vehicle information relevant to the acceleration of the vehicle 10, such as a change in the speed of the vehicle 10 or the brake pressure.

In the second embodiment, an example of processing in which the decision unit 306 decides the first risk level by comparing the brake pressure of the vehicle 10 with one or more first threshold values will be described.

Figure 12:
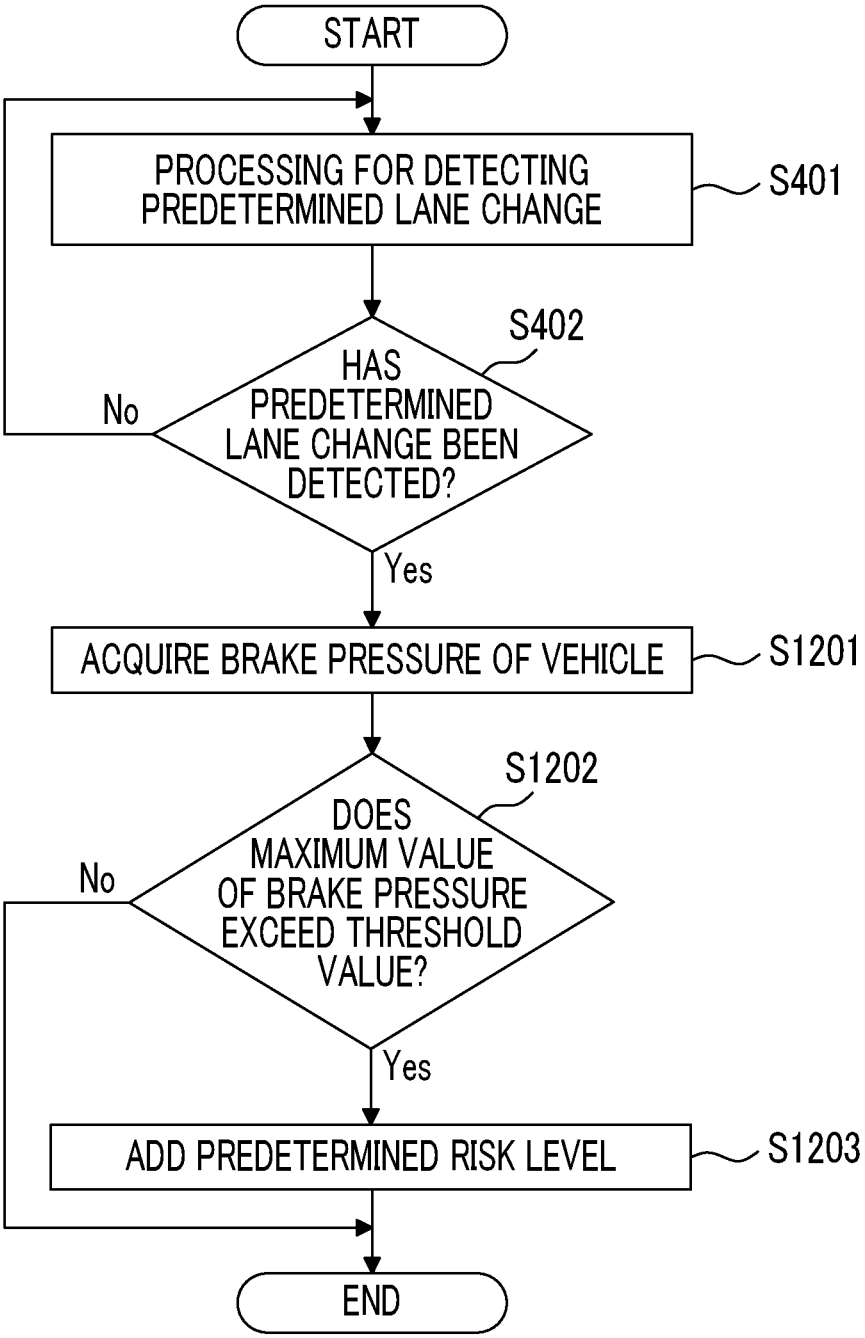
FIG. 12 is a flowchart showing an example of a risk level determination process according to a second embodiment.

FIG. 12 is a flowchart showing the flow of a risk level determination process according to the second embodiment. Since the processing of steps S401 and S402 in the process shown in FIG. 12 is the same as the processing shown in FIG. 4, the following description will be focused on the differences from the process shown in FIG. 4 herein.

In step S1201, the acceleration information acquisition unit 304 of the in-vehicle device 110 acquires information indicating the acceleration of the vehicle 10. For example, the acceleration information acquisition unit 304 acquires information of the brake pressure of the vehicle 10 from the vehicle control ECU that controls the vehicle 10 or the like using the vehicle information acquisition unit 305.

The brake pressure of the vehicle 10 is another example of the information indicating the acceleration of the vehicle 10. For example, the acceleration information acquisition unit 304 may acquire vehicle information, such as the speed of the vehicle 10, in addition to the brake pressure of the vehicle 10.

In step S1202, the decision unit 306 of the in-vehicle device 110 judges whether or not the maximum value of the brake pressure acquired in step S1201 exceeds a threshold value. In a case where the maximum value of the brake pressure does not exceed the threshold value, the decision unit 306 ends the processing. On the other hand, in a case where the maximum value of the brake pressure exceeds the threshold value, the decision unit 306 proceeds to step S1203.

In step S1203, the decision unit 306 of the in-vehicle device 110 adds a predetermined risk level to decide the first risk level.

In steps S1202 and S1203, for example, similarly to the processing shown in FIG. 6B, the decision unit 306 may decide the first risk level by comparing the acquired maximum value of the brake pressure with a plurality of threshold values.

As described above, the decision unit 306 of the in-vehicle device 110 may execute the same processing as in the first embodiment using the vehicle information of the vehicle 10 instead of the acceleration of the vehicle 10.

Third Embodiment

In the first embodiment, the in-vehicle device 110 detects other vehicles around the vehicle 10 using the image data obtained by imaging the periphery of the vehicle 10 with the camera 130. However, the disclosure is not limited thereto, and the in-vehicle device 110 may detect other vehicles around the vehicle 10 using the distance sensor 140, the inter-vehicle communication device 150, or the like.

Instead of the acceleration of the vehicle 10, the in-vehicle device 110 may determine the risk level of a predetermined lane change by comparing information indicating the distance between the vehicle 10 and another vehicle with one or more threshold values (second threshold value).

Functional Configuration

Figure 13:
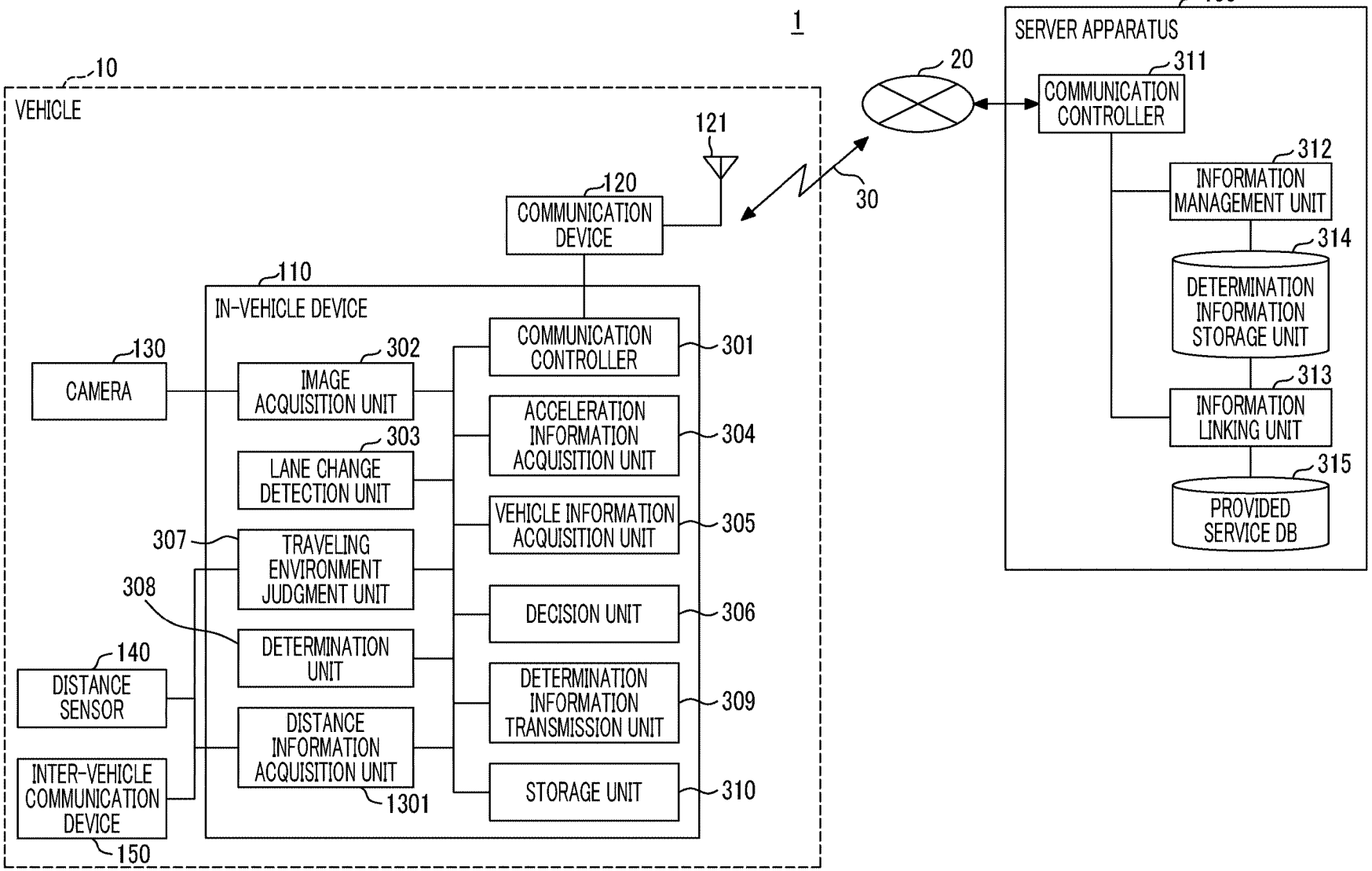
FIG. 13 is a diagram showing an example of the functional configuration of an information processing system according to a third embodiment.

FIG. 13 is a diagram showing an example of the functional configuration of the information processing system according to the third embodiment. The in-vehicle device 110 according to the third embodiment has a distance information acquisition unit 1301 in addition to the functional configuration of the in-vehicle device 110 according to the first embodiment shown in FIG. 3.

The distance information acquisition unit (second information acquisition unit) 1301 is realized by, for example, a program executed by the CPU 201, and acquires information indicating the distance between the vehicle 10 in a case where a predetermined lane change is made and another vehicle. For example, in a case where a predetermined lane change is detected by the lane change detection unit 303, the distance information acquisition unit 1301 acquires information indicating the distance between the vehicle 10 and another vehicles traveling in front of or behind the vehicle 10 from the distance sensor 140 or the inter-vehicle communication device 150 mounted in the vehicle 10.

Desirably, the distance information acquisition unit 1301 converts the distance between the vehicle 10 and another vehicle into time using the distance acquired from the distance sensor 140 or the like and the speed of the vehicle 10 acquired from the vehicle information acquisition unit 305 or the like, and acquires a time-converted inter-vehicle distance. This is because the appropriate inter-vehicle distance changes according to the speed of the vehicle 10. For example, in the case of 60 km/h, the inter-vehicle distance of 30 m corresponds to a travel time of 30÷(60000÷3600) =1.8 seconds. The time-converted inter-vehicle distance is an example of information indicating the distance between the vehicle 10 and another vehicle.

The decision unit 306 according to the third embodiment decides a second risk level indicating the risk level of the driving operation using the information indicating the distance between the vehicle 10 and another vehicle acquired by the distance information acquisition unit 1301. For example, the decision unit 306 decides the second risk level by storing correspondence information 1400 indicating the correspondence relationship between the time-converted distance and the risk level, which is shown in FIG. 14B, in the storage unit 310 and adding the risk level according to the time-converted distance.

Figures 14A, 14B:
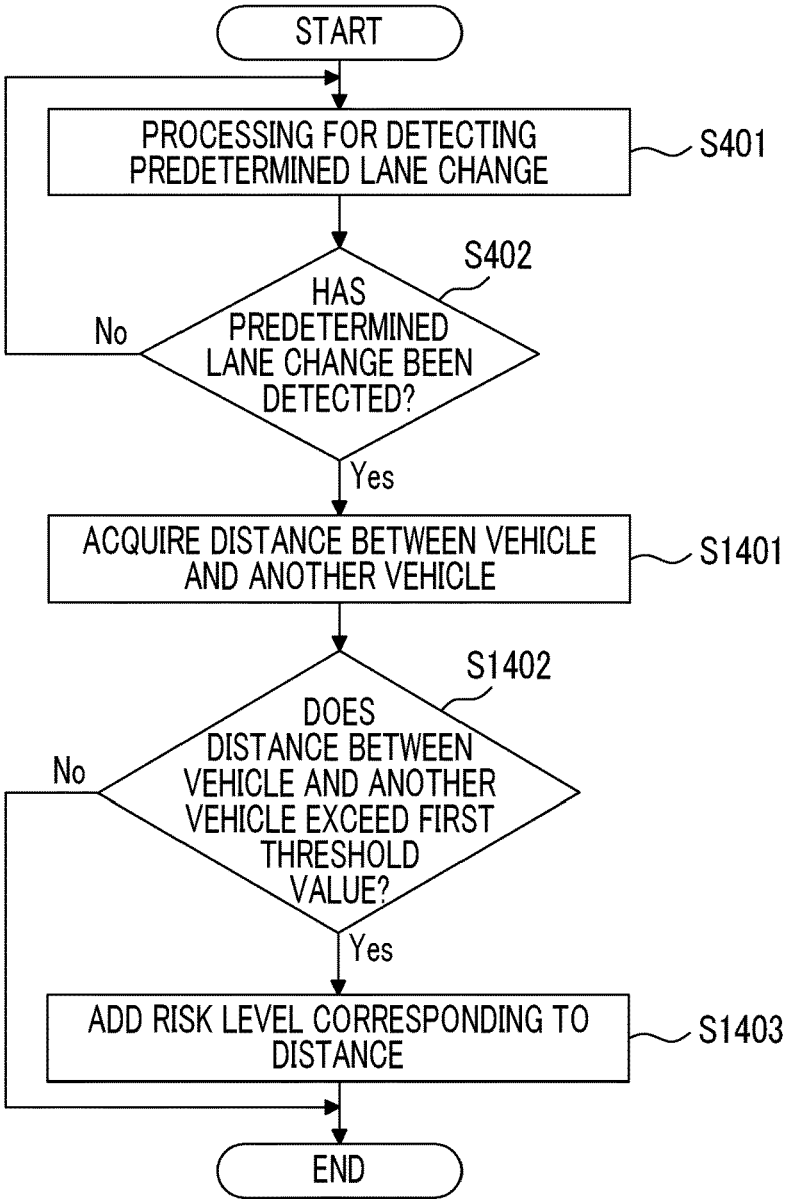
FIG. 14A is a flowchart showing an example of a risk level determination process according to the third embodiment.
FIG. 14B is a table showing an example of a risk level determination process according to the third embodiment.

In the example shown in FIG. 14B, the decision unit 306 can decide the risk level by comparing the time-converted distance with three threshold values (one or more second threshold values) of 1.5 seconds, 2.0 seconds, and 3.0 seconds. Here, the second risk level is an example of information indicating the risk level of the driving operation, which is decided based on the information indicating the distance between the vehicle 10 and another vehicle.

The distance sensor 140 is realized by, for example, a millimeter wave sensor or light detection and ranging or laser imaging detection and ranging (LIDAR). The distance information acquisition unit 1301 acquires the distance between the vehicle 10 and a vehicle ahead or behind from the distance sensor 140.

The inter-vehicle communication device 150 is realized by, for example, dedicated short range communications (DSRC) conforming to IEEE802.11p standards. The distance information acquisition unit 1301 may acquire vehicle information transmitted from another vehicle using the inter-vehicle communication device 150, or may calculate the distance between the vehicle 10 and another vehicle using positional information included in the vehicle information.

The functional configurations of the in-vehicle devices 110 and the server apparatus 100 other than those described above may be the same as the functional configuration according to the first embodiment shown in FIG. 3.

Flow of Process

FIGS. 14A and 14B are a flowchart and a table showing an example of risk level determination processing according to the third embodiment. Since the processing of steps S401 and S402 in the flowchart shown in FIG. 14A is the same as the processing shown in FIG. 4, the following description will be focused on the differences from the process shown in FIG. 4 herein.

In step S1401, the distance information acquisition unit 1301 of the in-vehicle device 110 acquires information indicating the distance between the vehicle 10 and another vehicle (for example, a time-converted distance).

In step S1403, the decision unit 306 of the in-vehicle device 110 judges whether or not the maximum value of the information indicating the distance between the vehicle 10 and another vehicle acquired in step S1401 exceeds the first threshold value.

For example, the decision unit 306 stores the correspondence information 1400 indicating the correspondence relationship between one or more second threshold values with the risk level, which is shown in FIG. 14B, in the storage unit 310. The decision unit 306 judges whether or not the maximum value of the time-converted distance acquired in step S1401 exceeds 1.5 seconds that is a minimum threshold value (first threshold value).

In a case where the maximum value of the information indicating the distance between the vehicle 10 and another vehicle does not exceed the first threshold value, the decision unit 306 ends the second risk level determination processing. On the other hand, in a case where the maximum value of the information indicating the distance between the vehicle 10 and another vehicle exceeds the first threshold value, the decision unit 306 proceeds to step S1403.

In step S1403, the decision unit 306 adds a risk level corresponding to the information indicating the distance between the vehicle 10 and another vehicle to decide the second risk level. For example, the decision unit 306 acquires a risk level corresponding to the maximum value of the time-converted distance using the correspondence information 1400 shown in FIG. 14B, and adds the acquired risk level to decide the second risk level.

In this case, as described above, the decision unit 306 may add the risk level to the initial value (for example, 0 points), or may add the risk level to the basic point based on other factors.

Through the above processing, the decision unit 306 of the in-vehicle device 110 can decide the second risk level by comparing the information indicating the distance between the vehicle 10 and another vehicle with a plurality of second threshold values.

The third embodiment can also be applied to, for example, the risk level determination process (2) shown in FIG. 11. That is, the determination unit 308 of the in-vehicle device 110 may judge the risk level of a predetermined lane change using the second risk level decided by the decision unit 306 and the traveling environment of the vehicle 10 judged by the traveling environment judgment unit 307.

Application Examples

While the preferred embodiments of the disclosure have been described above, the disclosure is not limited to the above-described embodiments, and various modifications or changes can be made within the scope of the disclosure described in the claims.

For example, the third embodiment can be implemented in combination with the first embodiment. In this case, the decision unit 306 of the in-vehicle device 110 decides the first risk level shown in the first embodiment and the second risk level shown in the third embodiment. The determination unit 308 of the in-vehicle device 110 judges the risk level of a predetermined lane change using the first and second risk levels decided by the decision unit 306 and the traveling environment of the vehicle 10 judged by the traveling environment judgment unit 307. For example, the determination unit 308 determines the risk level of a predetermined lane change by adding the first and second risk levels to the above-described initial value, basic point, or the like.

As described above, the in-vehicle device 110 can more correctly determine the risk level of a predetermined lane change based on the information indicating the acceleration of the vehicle 10 and the information indicating the distance between the vehicle 10 and another vehicle.

What is claimed is:

1. An in-vehicle device comprising first circuitry configured to:

detect that a predetermined lane change has been made in a vehicle;

acquire information indicating acceleration of the vehicle, the acceleration being an acceleration at a time when the lane change is made;

acquire image data obtained by imaging a periphery of the vehicle;

detect a predetermined event in front of the vehicle by analyzing the image data acquired by the first circuitry;

judge a traveling environment of the vehicle, the traveling environment being a traveling environment when the lane change is made, based upon the presence or absence of the predetermined event;

decide a first risk level by comparing the information indicating the acceleration acquired by the first circuitry with one or more first threshold values when the predetermined event is not detected;

determine a risk level of the lane change using the first risk level decided by the first circuitry and the traveling environment of the vehicle judged by the first circuitry; and stop risk level decision processing of the first circuitry or invalidate the risk level decided by the first circuitry when the first circuitry detects the predetermined event, wherein the predetermined event is an event in which a rapid deceleration operation of the vehicle is unavoidable.

2. The in-vehicle device according to claim 1, wherein the first circuitry is configured to:

acquire information indicating a distance between the vehicle and another vehicle, the distance being a distance when the lane change is made;

decide a second risk level by comparing the information indicating the distance acquired by the first circuitry with one or more second threshold values; and determine the risk level of the lane change by further using the second risk level decided by the first circuitry.

3. An in-vehicle device comprising first circuitry configured to:

detect that a predetermined lane change has been made in a vehicle;

acquire a time-converted information indicating a distance between the vehicle and another vehicle, the distance being a distance when the lane change is made;

acquire image data obtained by imaging a periphery of the vehicle;

detect a predetermined event in front of the vehicle by analyzing the image data acquired by the first circuitry;

judge a traveling environment of the vehicle, the traveling environment being a traveling environment when the lane change is made, based upon the presence or absence of the predetermined event;

decide a second risk level by comparing the time-converted information indicating the distance between the vehicle and another vehicle acquired by the first circuitry with one or more second threshold values when the time-converted information indicating the distance between the vehicle and another vehicle exceeds a first threshold value;

determine a risk level of the lane change using the second risk level decided by the first circuitry and the traveling environment of the vehicle judged by the first circuitry; and stop risk level decision processing of the first circuitry or invalidate the risk level decided by the first circuitry when the first circuitry detects the predetermined event, wherein the predetermined event is an event in which a rapid deceleration operation of the vehicle is unavoidable.

4. The in-vehicle device according to claim 1, wherein the predetermined event includes detection of a red light, a pedestrian, or an obstacle in front of the vehicle.

5. The in-vehicle device according to claim 3, wherein the predetermined event includes detection of a red light, a pedestrian, or an obstacle in front of the vehicle.

6. The in-vehicle device according to claim 1, wherein the predetermined lane change includes a lane change for the vehicle to overtake or pass another vehicle.

7. The in-vehicle device according to claim 3, wherein the predetermined lane change includes a lane change for the vehicle to overtake or pass another vehicle.

8. The in-vehicle device according to claim 1, wherein that the predetermined lane change includes a lane change in which the vehicle moves forward or backward with respect to another vehicle.

9. The in-vehicle device according to claim 3, wherein that the predetermined lane change includes a lane change in which the vehicle moves forward or backward with respect to another vehicle.

10. The in-vehicle device according to claim 1, further comprising a transmission unit configured to transmit determination information including a determination result of the first circuitry to an information processing apparatus that is linked with a predetermined service provided to a user of the vehicle.

11. The in-vehicle device according to claim 3, further comprising a transmission unit configured to transmit determination information including a determination result of the first circuitry to an information processing apparatus that is linked with a predetermined service provided to a user of the vehicle.

12. An information processing system comprising:

the in-vehicle device according to claim 10; and an information processing apparatus configured to communicate with the in-vehicle device through a network, wherein the information processing apparatus includes a receiver configured to receive determination information, which is transmitted from the in-vehicle device and includes a determination result of a risk level of a lane change by a vehicle in which the in-vehicle device is mounted, and second circuitry configured to manage one or more pieces of the determination information received by the receiver by storing the pieces of the determination information in a storage unit, and link one or more pieces of the determination information managed by the second circuitry with the predetermined service provided to the user.

13. An information processing system comprising:

the in-vehicle device according to claim 11; and an information processing apparatus configured to communicate with the in-vehicle device through a network, wherein the information processing apparatus includes a receiver configured to receive determination information, which is transmitted from the in-vehicle device and includes a determination result of a risk level of a lane change by a vehicle in which the in-vehicle device is mounted, and second circuitry configured to manage one or more pieces of the determination information received by the receiver by storing the pieces of the determination information in a storage unit, and link one or more pieces of the determination information managed by the second circuitry with the predetermined service provided to the user.

14. An information processing method characterized by comprising:

detecting that a predetermined lane change has been made in a vehicle by using a computer;

acquiring information indicating acceleration of the vehicle, the acceleration being an acceleration at a time when the lane change is made by using the computer;

acquire image data obtained by imaging a periphery of the vehicle;

detect a predetermined event in front of the vehicle by analyzing the image data acquired by the computer;

judging a traveling environment of the vehicle, the traveling environment being a traveling environment when the lane change is made by using the computer, based upon the presence or absence of the predetermined event;

deciding a first risk level by comparing the acquired information indicating the acceleration with one or more threshold values by using the computer when the predetermined event is not detected;

determining a risk level of the lane change using the decided first risk level and the judged traveling environment of the vehicle by using the computer; and stop risk level decision processing of the computer or invalidate the risk level decided by computer when the computer detects the predetermined event, wherein the predetermined event is an event in which a rapid deceleration operation of the vehicle is unavoidable.

* * * * *